US010244901B2

(12) United States Patent
Ophardt et al.

(10) Patent No.: US 10,244,901 B2
(45) Date of Patent: Apr. 2, 2019

(54) LEVITATION FLUID DISPENSER

(71) Applicant: OP-Hygiene IP GmbH, Niederbipp (CH)

(72) Inventors: Heiner Ophardt, Arisdorf (CH); Albrecht Lang, Niederbipp (CH); Siegfried Steltenkamp, Bonn (DE); David Duncan, St. Catharines (CA); Valery Ten, Hannon (CA)

(73) Assignee: OP-Hygiene IP GmbH, Niederbipp (CH)

( * ) Notice: Subject to any disclaimer, the term of this patent is extended or adjusted under 35 U.S.C. 154(b) by 108 days.

(21) Appl. No.: 15/360,379

(22) Filed: Nov. 23, 2016

(65) Prior Publication Data

US 2017/0143171 A1 May 25, 2017

Related U.S. Application Data

(60) Provisional application No. 62/259,529, filed on Nov. 24, 2015.

(51) Int. Cl.

| | |
|---|---|
| ***A01B 1/00*** | (2006.01) |
| ***A47K 5/12*** | (2006.01) |
| ***E03C 1/04*** | (2006.01) |

(52) U.S. Cl.

CPC ..... *A47K 5/1217* (2013.01); *A47K 5/1202* (2013.01); *E03C 1/0404* (2013.01); *A47K 5/1211* (2013.01); *A47K 2005/1218* (2013.01)

(58) Field of Classification Search

CPC .. A47K 5/1217; A47K 5/1202; A47K 5/1211; A47K 2005/1218; E03C 1/0404

See application file for complete search history.

(56) References Cited

U.S. PATENT DOCUMENTS

| | | | | |
|---|---|---|---|---|
| 2,281,051 | A * | 4/1942 | Roger | A47K 5/1214 119/72.5 |
| 5,215,688 | A | 6/1993 | Williamson et al. | |
| 5,558,837 | A | 9/1996 | Tsukishima | |
| 5,810,155 | A * | 9/1998 | Hashimoto | B06B 3/00 198/630 |
| 6,045,341 | A | 4/2000 | Mak | |
| 6,168,638 | B1 * | 1/2001 | Kasim | C30B 33/00 117/901 |
| 6,358,288 | B1 | 3/2002 | Kasim et al. | |
| 6,455,982 | B1 * | 9/2002 | Hashimoto | B65G 35/005 310/328 |
| 7,295,418 | B2 | 11/2007 | Vernitsky | |

(Continued)

FOREIGN PATENT DOCUMENTS

| | | |
|---|---|---|
| CN | 201629075 | 11/2010 |
| EP | 0018137 | 10/1980 |

*Primary Examiner* — Patrick M Buechner
*Assistant Examiner* — Michael J Melaragno
(74) *Attorney, Agent, or Firm* — Thorpe North and Western, LLP

(57) ABSTRACT

A hand cleaner fluid dispenser, including a reservoir for containing hand cleaner fluid to be dispensed; a dispenser outlet for discharge of the hand cleaner fluid from the reservoir; and a discharge mechanism operable to discharge a drop of the hand cleaner fluid from the dispenser outlet when activated. A levitator device is incorporated into the hand cleaner fluid dispenser, and is operable to levitate the drop of hand cleaner fluid at a position where the drop is accessible to be taken by a user's hand.

20 Claims, 28 Drawing Sheets

(56) References Cited

U.S. PATENT DOCUMENTS

| | | | | |
|---|---|---|---|---|
| 7,984,825 | B2 | 7/2011 | Ophardt et al. | |
| 8,684,236 | B2 | 4/2014 | Ophardt | |
| 9,488,751 | B2 * | 11/2016 | Suzuki | G01V 8/12 |
| 2003/0049642 | A1 * | 3/2003 | Nilsson | C30B 29/58 435/6.16 |
| 2003/0171064 | A1 * | 9/2003 | Cusolito | A63H 33/40 446/179 |
| 2009/0266908 | A1 * | 10/2009 | Michelsen | B05B 1/06 239/17 |
| 2017/0120249 | A1 * | 5/2017 | Umbanhowar | B01L 3/502792 |
| 2017/0335553 | A1 * | 11/2017 | Martin | E03C 1/057 |

* cited by examiner

LEVITATION FLUID DISPENSER

FIELD OF THE INVENTION

This invention relates to devices that dispense fluids, notably hand fluids to be used on a person's hands such as hand soap or hand sanitizer. More particularly, the invention provides a fluid dispenser having a levitation device for suspending a drop of hand fluid in midair, and a method of dispensing a fluid by levitating a drop of the fluid for grasping by a hand of a user.

BACKGROUND OF THE INVENTION

The importance of regular hand cleaning in reducing the spread of infectious disease is well known. Nonetheless, many individuals fail to wash their hands regularly. These individuals may, for example, forget to wash their hands, fail to notice hand cleaning stations, or consider hand washing to be a tedious and unstimulating activity.

The present inventors have appreciated that the experience of the application of fluids including hand cleaning onto a user's hand could be improved by providing a visually interesting display of the fluid, thereby attracting attention and encouraging more frequent application of fluids to a user's hand and hand cleaning.

SUMMARY OF THE INVENTION

To at least partially overcome some of the disadvantages of previously known devices, the invention provides a fluid dispenser that incorporates a levitation device, and a method of dispensing a fluid by levitating a drop of the fluid. The levitation device is operable to levitate a drop of fluid at a position where the drop is readily visible and accessible to be taken by a user's hand.

The present inventors have appreciated that a levitating drop of a fluid, visibly floating in midair, can attract the attention and interest of nearby individuals, and encourage them to grasp the fluid with their hands. For example, the dispenser preferably incorporates a proximity sensor which triggers the discharge and levitation of a drop of fluid upon detecting a nearby individual. A display of lights and/or sounds could also be used to draw attention to the levitating drop, and encourage the individual to approach the display and grasp the drop with his or her hands before leaving the area. The levitating drop could be lit up, rotated, moved up and down, and/or moved along a path, such as a circle or FIG. 8, to further draw attention thereto.

The levitating drop is levitated such that it may be grasped by a person's hand, preferably with the user's hand swiping the drop, by moving the user's hand to engage the levitating drop. Preferably, the user's hand is moved into engagement with the drop that the drop is engaged by the hand while still levitated. Preferably, the hand is moved sideways to grasp the drop.

The fluid of the drop may be grasped directly by the hand of a person to engage the skin of the hand or may be grasped with the user holding a substrate such as a cloth, tissue, paper towel or other substrate or object in the user's and which the drop is to engage.

The fluid may preferably be a "hand fluid" to be used on the user's hands. The fluid may be a "user fluid" to be used on a person, for example, by grasping by the user's hand and applied to other portions of a user's body such as onto a person's external skin such as to their face, feet, arms, legs, torso, anus and onto their hair.

As used in this application, the term "hand fluid" means a fluid that is to be used on the hands of a person including without limitation fluids for cleaning, disinfecting, sanitizing, moisturizing, medicating, insect repelling, scenting and perfuming. More specific examples of such hand fluids include hand soap, alcohol based sanitizing and cleaning compositions, skin moisturizing fluids and lotions, fluids containing medications such as anti-itching components, skin healing components, fungicides, bactericides and the like, insect repellent fluids, and perfumes.

User fluids include the above fluids which are "hand fluids" and include fluids for other uses such as hemorrhoidal medications, foot deodorant liquids, hair conditioner liquids, hair shampoos, shaving liquids, depilatory liquids, lubricants, teeth cleaning liquid and the like.

Insofar as the drop is engaged by a substrate, like a paper tissue held in the user's hand, then the fluid may be almost any manner of fluid that is desired to be applied to an object via the substrate, preferably to a person's body but to other objects such as to surfaces to be treated or cleaned like reading glasses, tabletops and the like.

In accordance with a first aspect, the present invention provides a fluid dispenser, comprising: a reservoir for containing fluid to be dispensed; a dispenser outlet for discharge of the fluid from the reservoir; a discharge mechanism operable to discharge a drop of the fluid from the dispenser outlet when activated; and a levitator device operable to levitate the drop of the fluid at a position where the drop is accessible to be taken by a user's hand.

In a $2^{nd}$ aspect, the fluid dispenser of the $1^{st}$ aspect is provided wherein the levitator device preferably is an aerodynamic levitator device providing an upwardly directed flow of air to levitate the drop.

In a $3^{rd}$ aspect, the fluid dispenser of the $2^{nd}$ aspect is provided wherein upwardly directed flow of air levitates the drop at heights above the levitator device within a range of positions where the drop is accessible to be taken by a user's hand for a period of time.

In a $4^{th}$ aspect, the fluid dispenser of the $3^{rd}$ aspect is provided wherein the period of time is at least one second.

In a $5^{th}$ aspect, the fluid dispenser of the $2^{nd}$, $3^{rd}$ or $4^{th}$ aspect is provided wherein:

the upwardly directed flow of air to levitate has a velocity profile disposed about a central vertical axis with a central portion of the velocity profile and an annular portion of the velocity profile annularly relative the axis about the central portion, over the central portion, the velocity profile portion having a velocity to levitate the drop above the central portion, over the annular portion, the velocity profile having a velocity greater than the velocity of the velocity profile over the central portion, the velocity of the velocity profile over the annular portion selected to direct a drop within the annular portion of the velocity profile adjacent the central portion of the velocity profile radially toward the central vertical axis.

In a $6^{th}$ aspect, the fluid dispenser of the $5^{th}$ aspect is provided wherein the velocity profile over the annular portion adjacent the central portion of the velocity profile decreasing with reduced radial distance from the axis.

In a $7^{th}$ aspect, the fluid dispenser of the $5^{th}$ aspect is provided wherein the levitator device has an air inlet and an air outlet, the levitator device comprises:

an upstream air flow collimator extending longitudinally along the axis from the air inlet at an inlet end to an exit end, a plurality of parallel straight-through upstream passageways for air flow through the upstream air flow collimator from the inlet end to the exit end, each upstream passageway extending parallel to the axis, a downstream air flow collimator extending longitudinally along the axis from an inlet end to an exit end open at the air outlet, a plurality of parallel straight-through downstream passageways for air flow through the downstream air flow collimator from the inlet end to the exit end, each downstream passageway extending parallel to the axis, a connecting shroud providing an internal guide passageway extending longitudinally along the axis from the exit end of the upstream air flow collimator to the inlet end of the downstream air flow collimator guiding the air exiting from the exit end of the upstream air flow collimator to the inlet end of the downstream air flow collimator, the guide passageway having at each point along the axis a cross-sectional area of the guide passageway normal to the axis, the cross-sectional area of the guide passageway normal to the axis staying not increasing from the exit end of the upstream air flow collimator to the inlet end of the downstream air flow collimator, the guide passageway having a reducing portion extending longitudinally along the axis over which the cross-sectional area of the guide passageway normal to the axis reduces gradually with proximity to the inlet to the downstream air flow collimator.

In an $8^{th}$ aspect, the fluid dispenser of the $5^{th}$ aspect is provided wherein the levitator device has an air inlet and an air outlet, the levitator device comprises a tubular air guide having a radially inwardly directed interior wall coaxial about the axis, the air guide open axially to the air inlet at an upstream end and open axially to the air outlet at a downstream end, the tubular air guide having a cylindrical upstream portion over which the interior wall is of a first radius about the axis, a cylindrical downstream portion over which the interior wall is of a second radius about the axis and an intermediate reducing portion bridging between the upstream portion and the downstream portion, over the reducing portion, the radius of the interior wall reducing gradually from the first radius to the second radius with proximity to the downstream portion.

In a $9^{th}$ aspect, the fluid dispenser of the $8^{th}$ aspect is provided including an upstream air flow collimator within the cylindrical upstream portion with a plurality of parallel straight-through upstream passageways for air flow, each upstream passageway extending parallel to the axis, air flow through the cylindrical upstream portion is through the upstream air flow collimator.

In a $10^{th}$ aspect, the fluid dispenser of the $9^{th}$ aspect is provided including:

a downstream air flow collimator within the cylindrical downstream portion with a plurality of parallel straight-through downstream passageways for air flow, each downstream passageway extending parallel to the axis, air flow through the cylindrical downstream portion is through the downstream air flow collimator.

In an $11^{th}$ aspect, the fluid dispenser of the $9^{th}$ or $10^{th}$ is provided including an intermediate cylindrical tubular internal guide tube member extending axially within the reducing portion coaxially about the axis of a radius less than the second radius.

In a $12^{th}$ aspect, the fluid dispenser of the $9^{th}$ aspect is provided including a cylindrical tubular internal guide tube member with an axially open upstream end and an axially open downstream end, the internal guide tube member extending axially through the reducing portion and the cylindrical downstream portion coaxially about the axis, the internal guide tube member having a radius less than the second radius to define within tubular air guide annularly about the internal guide tube member an annular passage for air flow.

In a $13^{th}$ aspect, the fluid dispenser of the $7^{th}$ to $12^{th}$ aspects is provided wherein the levitator device includes an air delivery device for delivering a stream of pressurized air to the air inlet.

In a $14^{th}$ aspect, the fluid dispenser of the $9^{th}$, $10^{th}$ or $11^{th}$ aspect is provided wherein the levitator device includes a pressure dampening mechanism to dampen changes in air pressure within the reducing portion.

In a $15^{th}$ aspect, the fluid dispenser of the $14^{th}$ aspect is provided wherein the pressure dampening mechanism is open to the reducing portion and dampens changes in air pressure within the reducing portion.

In a $16^{th}$ aspect, the fluid dispenser of the $14^{th}$ or $15^{th}$ aspect is provided wherein the pressure dampening mechanism comprises a variable volume compartment in communication with the reducing portion, the compartment defined within a confining wall having a resilient panel having an inherent bias to adopt an inherent condition in which the compartment has an inherent volume and which resilient panel resiliently stretches from its inherent condition to biased conditions in which the compartment has biased volumes greater than the inherent volume as the air pressure in the compartment increases.

In a $17^{th}$ aspect, the fluid dispenser of the $1^{st}$ or $2^{nd}$ aspect is provided wherein the levitator device comprises:

an air pump; and a plurality of air outlets in fluid communication with the air pump for creating an upwardly directed air stream for levitating the drop of fluid.

In a $18^{th}$ aspect, the fluid dispenser of the $17^{th}$ aspect is provided wherein the air outlets are annularly arranged around the dispenser outlet, and the dispenser outlet is configured to discharge the drop of fluid upwards into the upwardly directed air stream.

In a $19^{th}$ aspect, the fluid dispenser of the $18^{th}$ aspect is provided wherein the annularly arranged air outlets form at least two concentric rings, including an inner ring that is proximate to the dispenser outlet and an outer ring that is distal from the dispenser outlet, wherein the air outlets of the outer ring expel air at a greater velocity than the air outlets of the inner ring, so that the upwardly directed air stream has a high velocity outer zone surrounding a lower velocity inner zone.

In a $20^{th}$ aspect, the fluid dispenser of the $1^{st}$ aspect is provided comprising:

a water outlet operable to dispense water onto the user's hand; and an air blower operable to produce an air flow for drying the user's hand.

In a $21^{st}$ aspect, the fluid dispenser of the $1^{st}$ aspect is provided comprising:

a water outlet operable to dispense water onto the user's hand;

an air delivery device for delivering a stream of pressurized air, an air discharge chute to receive the stream of pressurized air and deliver it as an exit stream for drying the user's hand, and a valve to selectively direct the stream of pressurized air to either the levitation device or the air discharge chute.

In a 22nd aspect, the fluid dispenser of any one of the 1st to 21st aspects is provided wherein the fluid is a person's fluid for use by application to a user's body.

In a 23rd aspect, the fluid dispenser of any one of the 1st to 21st aspects is provided wherein the fluid is a hand fluid for use on the user's hand.

In a 24th aspect, the fluid dispenser of the 23rd aspect is provided wherein the hand fluid comprises a hand cleaning fluid.

In a 25th aspect, the fluid dispenser of the 22nd aspect is provided wherein the fluid includes one or more of a skin cleaner, a skin moisturizer, a skin disinfectant, a skin medication, an insect repellant and a skin perfume.

In a 26th aspect, the present invention provides a method of dispensing a fluid comprising:

levitating in air a first drop of the fluid where the drop is accessible to be taken by a user's hand.

In a 27th aspect, the method of the 26th aspect includes comprising aerodynamic levitating the drop with an upwardly directed flow of air.

In a 28th aspect, the method of the 26th or 27th aspect includes comprising levitating the drop at heights above the levitator device within a range of positions where the drop is accessible to be taken by a user's hand for a period of time.

In a 29th aspect, the method of the 27th aspect wherein the period of time is at least one second.

In a 30th aspect, the method of the 26th, 27th or 28th aspect including:

providing the upwardly directed flow of air to levitate with a velocity profile disposed about a central vertical axis with a central portion of the velocity profile and an annular portion of the velocity profile annularly relative the axis about the central portion, over the central portion, the velocity profile portion providing a velocity to levitate the drop above the central portion, over the annular portion, the velocity profile providing a velocity greater than the velocity of the velocity profile over the central portion, providing the velocity of the velocity profile over the annular portion to be selected to direct a drop within the annular portion of the velocity profile adjacent the central portion of the velocity profile radially toward the central vertical axis.

In a 31st aspect, the method of the 26th, 27th or 28th aspect including providing the velocity profile over the annular portion adjacent the central portion of the velocity profile to decrease with reduced radial distance from the axis.

In a 32nd aspect, the method of any one of the 26th to 31st aspects including:

providing a reservoir for containing hand cleaner fluid to be dispensed;

discharging an allotment of the hand cleaner fluid from the reservoir out a discharge outlet to form the drop;

discharging the drop into the upwardly directed flow of air with a velocity and at a direction that the drop is directed by the velocity profile to levitate the drop above the central portion.

In a 33rd aspect, the method of any one of the 26th to 30th aspects includes while levitating the first drop, levitating a second drop of the hand cleaner fluid accessible to be taken by a user's hand proximate where the first drop is accessible to be taken by a user's hand.

In a 34th aspect, the method of any one of the 26th to 33rd aspects including after levitating the drop for a period of time, collecting the drop in a collection vessel.

In a 35th aspect, the method of the 34th aspect including controlling levitation of the drop to cause the drop to descend downward towards the collection vessel.

In a 36th aspect, the method of any one of the 26th to 35th aspects including:

monitoring whether or not the drop is at heights above the levitator device within a range of positions where the drop is accessible to be taken by a user's hand, if the monitoring indicates the drop is not at heights above the levitator device within a range of positions where the drop is accessible to be taken by a user's hand, then discontinuing the levitating.

In a 37th aspect, the method of any one of the 26th to 36th aspects including sensing when a user is proximate where the drop is to be levitated.

In a 38th aspect, the method of the 26th aspect including:

sensing when a user is proximate where the drop is to be levitated;

on sensing a user to be proximate to where the drop is to be levitated, levitating in air the first drop of the hand cleaner fluid where the drop is accessible to be taken by the user's hand.

In a 39th aspect, the method of the 38th aspect including repeatedly levitating successive drops of the liquid while the user is sensed to be proximate to where the drop is to be levitated.

In a 40th aspect, the method of the 39th aspect including, after levitating in air, each successive drop of the hand cleaner fluid where each successive drop is accessible to be taken by a user's hand for a period of time, levitating in air a next successive drop of the hand cleaner fluid where the drop is accessible to be taken by a user's hand.

In a 41st aspect, the method of any one the 26th to 40th aspects wherein the fluid is a person's fluid for use by application to a user's body.

In a 42nd aspect, the method of any one of the 26th to 40th aspects wherein the fluid is a hand fluid for use on the user's hand.

In a 43rd aspect, the method of the 42nd aspect wherein the hand fluid comprises a hand cleaning fluid.

In a 44th aspect, the method of the 41st aspect wherein the fluid includes one or more of a skin cleaner, a skin moisturizer, a skin disinfectant, a skin medication, an insect repellant and a skin perfume.

In a 45th aspect, the method of any one of the 26th to 44th aspects wherein the range of positions where the drop is accessible to be taken by a user's hand permits the drop to be grasped by the user's hand without the user's hand engaging anything other than the drop and air within which the drop is levitated.

In a 46th aspect, the method of any one of the 26th to 45th aspects including:

while a user is sensed to be proximate where the drop is to be levitated, (i) performing a series of steps of:

(a) conducting a first monitoring indicating that a first drop was at a height above the levitator device within a range of positions where a drop is accessible to be taken by a user's hand, followed by (b) conducting a second monitoring indicating that a first drop is not at a height above the levitator device within a range of positions where the drop is accessible to be taken by a user's hand, and (c) promptly levitating a subsequent drop, and (ii) repeating the series of steps (i) and (ii) until the cumulative volume of fluid of the first drop and each successive drop represents a predetermined volume suitable for a predetermined use of the fluid.

BRIEF DESCRIPTION OF THE DRAWINGS

Further aspects and advantages of the invention will appear from the following description taken together with the accompanying drawings, in which:

FIG. 22 1 is a top view of the upstream air flow collimator of FIG. 210;

DETAILED DESCRIPTION OF THE DRAWINGS

Figure 1:
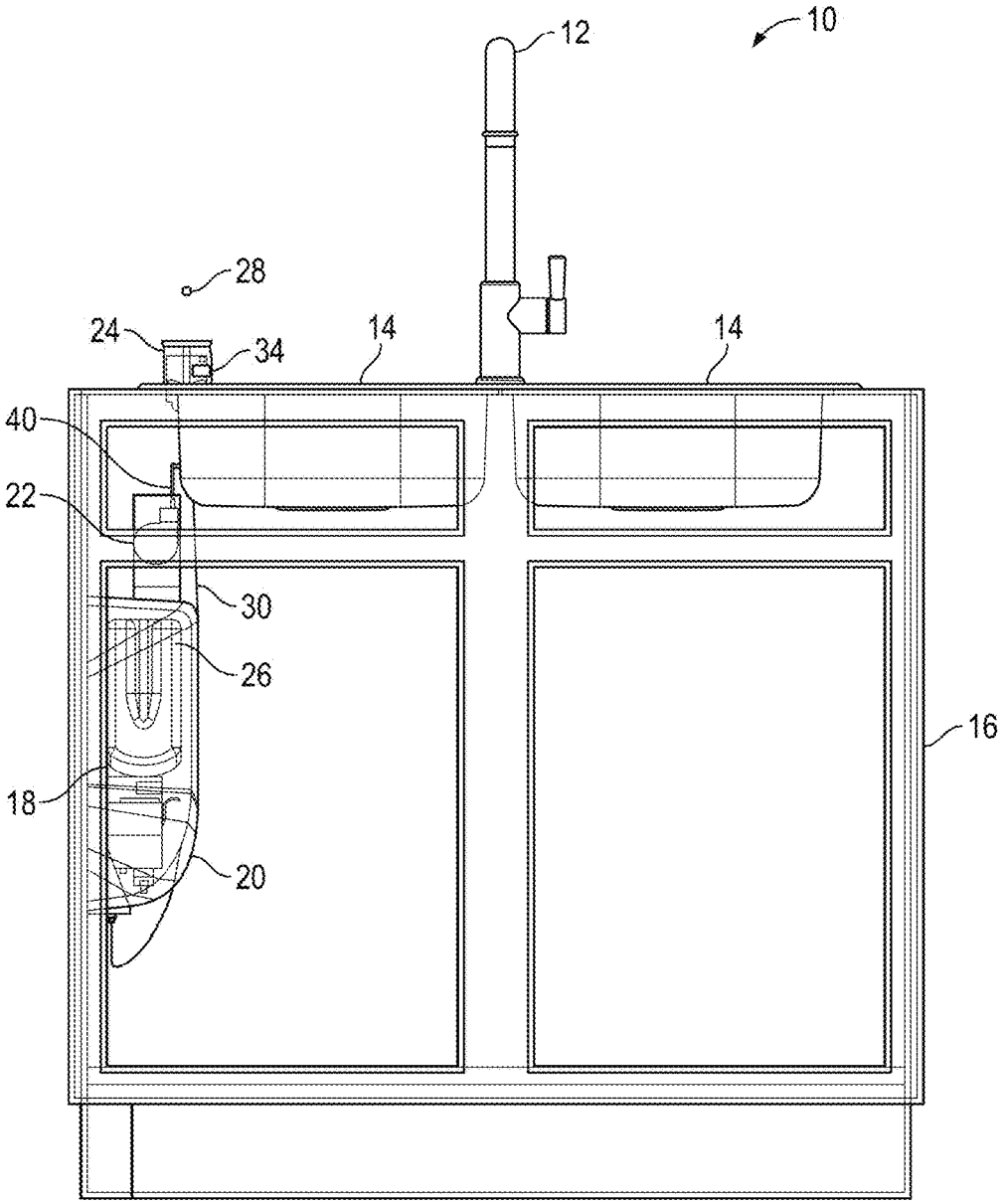
FIG. 1 shows a partially transparent front view of a hand cleaning station in accordance with a first preferred embodiment of the invention.
Figure 2:
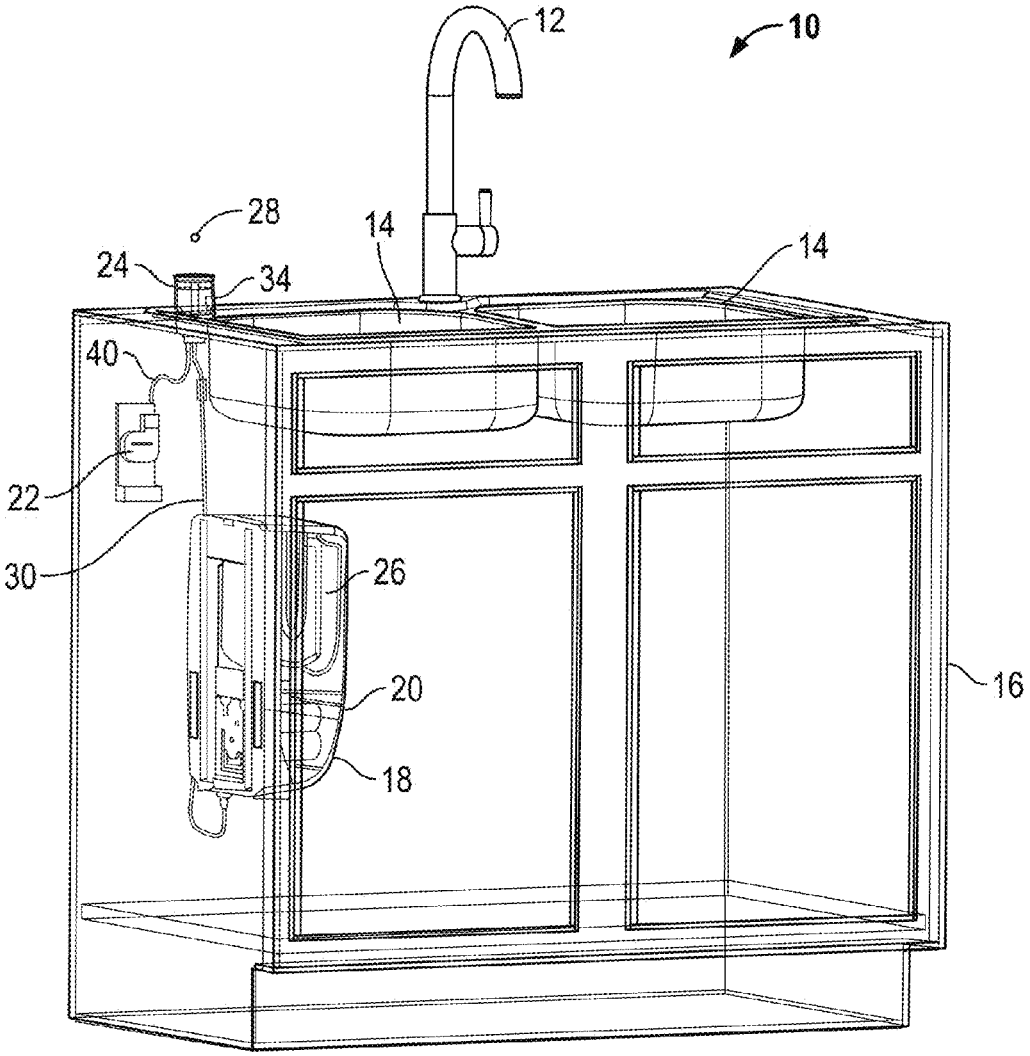
FIG. 2 shows a partially transparent perspective view of the hand cleaning station shown in FIG. 1.

Reference is made first to FIGS. 1 and 2, which show a hand cleaning station 10 in accordance with a first preferred embodiment of the invention. The hand cleaning station 10 includes a faucet 12, a pair of sinks 14, a cabinet 16, and a hand cleaner dispenser 18. The hand cleaner dispenser 18 includes a drop discharge mechanism 20 also referred to as a dispenser unit 20, an air delivery device such as an air pump 22, and a levitator device 24. The dispenser unit 20 is similar to that disclosed in U.S. Pat. No. 7,984,825 to Ophardt et al., issued Jul. 26, 2011, and in U.S. Pat. No. 8,684,236 to Ophardt, issued Apr. 1, 2014, both of which are incorporated herein by reference.

The dispenser unit 20 has a reservoir 26 that contains hand cleaner fluid, such as hand soap or hand sanitizer. An electrically powered discharge mechanism of the dispenser unit 20 is operable to pump a drop 28 of the hand cleaner fluid from the reservoir 26 through an outlet line 30 and out through a dispenser outlet 32 of the levitator device 24. The discharge mechanism is configured to pump a volume of air immediately following the drop 28, preferably expelled with sufficient force to launch the drop 28 from the dispenser outlet 32 to an airborne position where it can be caught and supported by an air cushion created by the levitator device 24, as will be described in more detail below. The discharge mechanism may, for example, incorporate the pump as described in Canadian Patent Application Ser. No. 2902751 to OP-HYGIENE IP GMBH, titled "Air Assisted Severance of Fluid Stream", which is incorporated herein by reference.

The levitator device 24 is provided with a proximity sensor 34. The proximity sensor 34 is configured to detect the presence of an individual standing in front of the hand cleaning station 10, and upon detecting the individual, trigger the activation of the discharge mechanism and the levitation device 24. The sudden appearance of a levitating drop 28 of hand cleaner fluid will likely draw the attention of the individual, encouraging him or her to take the levitating drop 28. In alternative embodiments, the discharge mechanism and levitator device 24 could be activated by any suitable trigger indicating a potential hand cleaning opportunity, such as the opening of the faucet 12.

Figure 6:
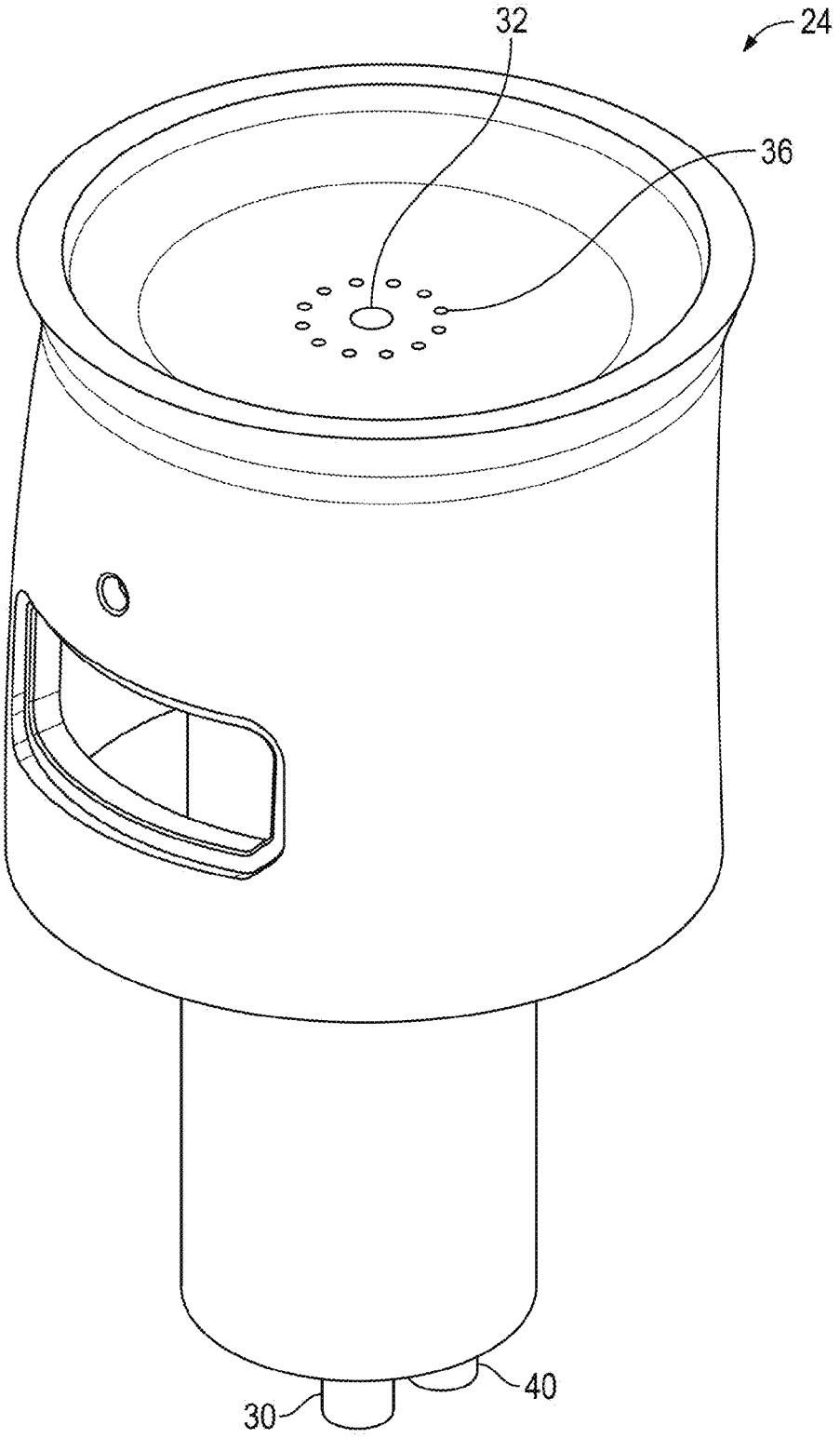
FIG. 6 shows a perspective view of the levitating device of the hand cleaning station shown in FIG. 1.
Figure 7:
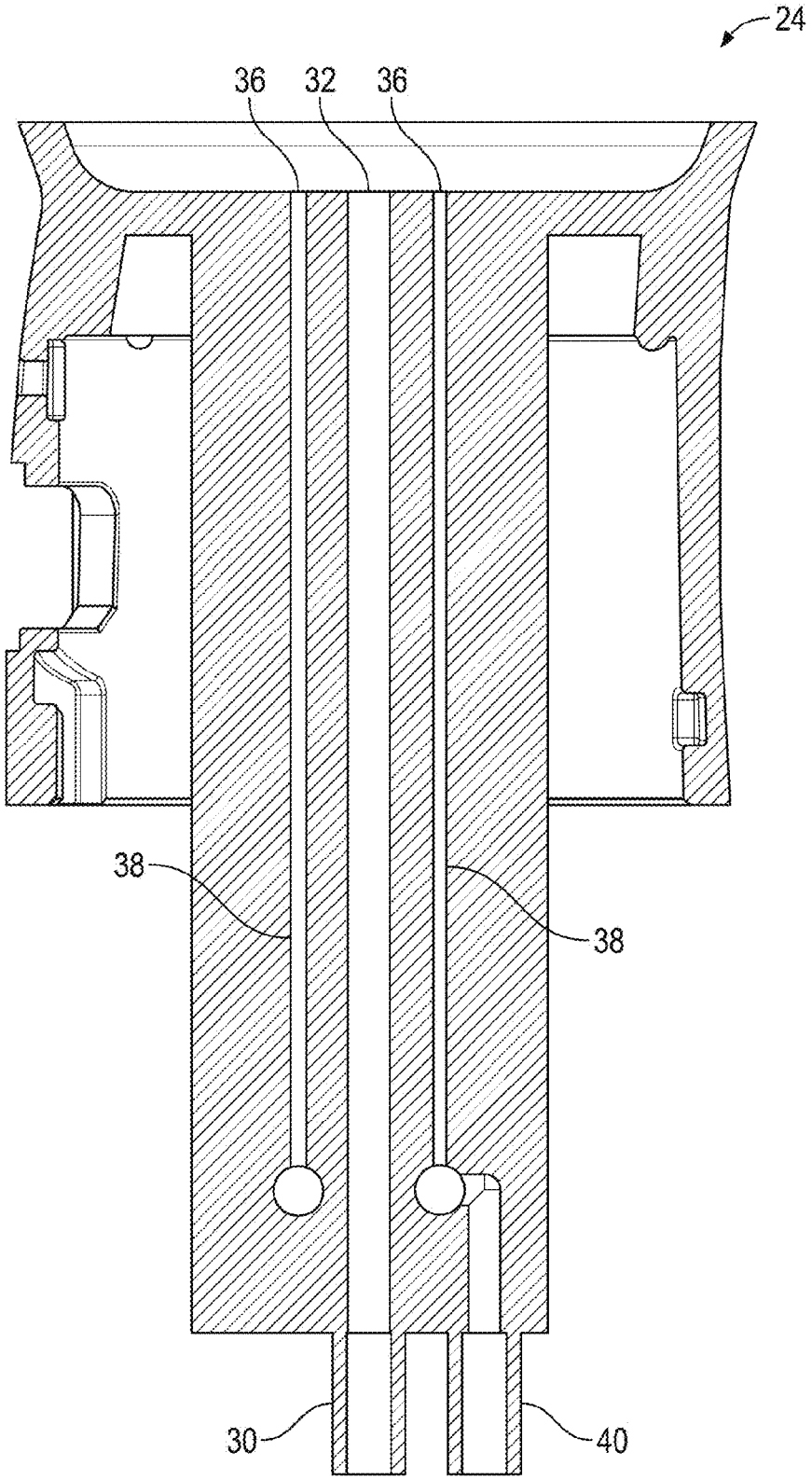
FIG. 7 shows a cross-sectional view of the levitating device shown in FIG. 6.

The levitator device 24 is best shown in FIGS. 6 and 7 as having a ring of air outlets 36 which surround the dispenser outlet 32. The air outlets 36 are fluidly connected by internal channels 38 and an air outlet line 40 to the air pump 22. The air pump 22 is activated in coordination with the discharge mechanism, and pumps air out through the air outlets 36 to create a cushion of air upon which the expelled drop 28 floats. The circular arrangement of air outlets 36 creates an area of reduced upwards air flow directly above the dispenser outlet 32. This causes the drop 28 to sit stably in the center of the air cushion. The air pump 22 may pump air by any suitable mechanism. For example, the air pump 22 could employ a ducted fan system or a supply of compressed air. Preferably, the levitator device 24 is configured to expel air with a laminar flow.

The levitating drop 28 is intended to attract the attention and interest of those nearby, and encourage them to clean their hands. The levitating drop 28 is located at a height above the cabinet 16 where it can be easily seen, and within reach of someone standing in front of the cleaning station 10. To further attract attention, the drop 28 could be made to rise up and down, by varying the velocity of the air expelled from the air outlets 36. Visual and/or auditory cues may also be used to draw attention to the levitating drop 28, and/or to provide directions for using the cleaning station 10. For example, a recorded voice could prompt a user to take the drop 28 with his or her hands. The levitator device 24 preferably incorporates a sensor which is able to detect when the drop 28 has been taken by a user, which causes the air pump 22 to be turned off.

Figure 8:
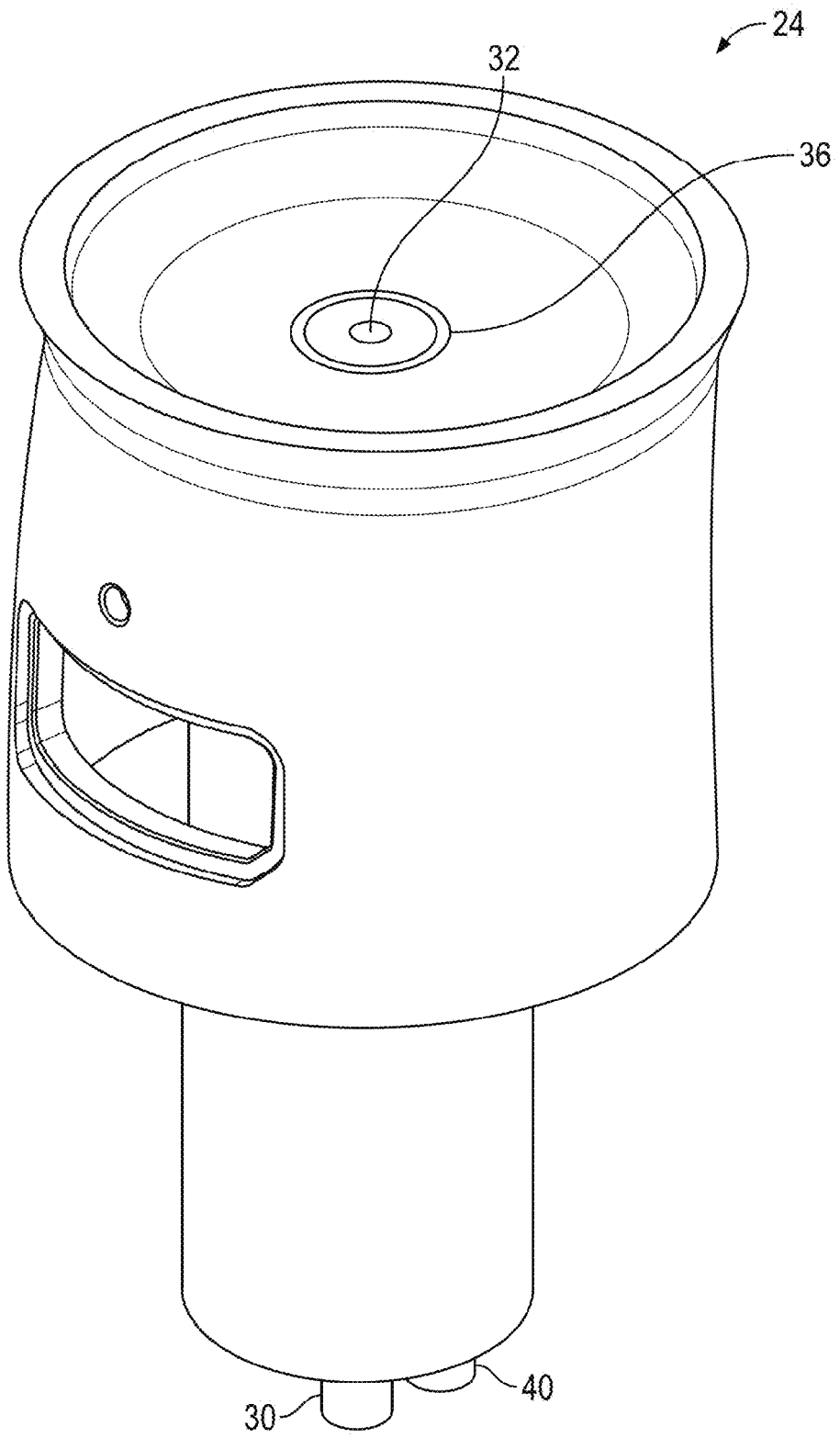
FIG. 8 shows a perspective view of a levitating device in accordance with a second preferred embodiment of the invention.

An alternate construction of the levitator device 24 in accordance with a second preferred embodiment of the invention is shown in FIG. 8, wherein like numerals are used to represent like components. The levitator device 24 shown in FIG. 8 corresponds identically to the levitator device shown in FIG. 6, with the exception that the plurality of circular air outlets 36 have been replaced by a single air outlet 36, formed as an annular slot surrounding the dispenser outlet 32. The air outlet 36 serves as a nozzle to provide the necessary air flow to levitate the drop 28. It is to be appreciated that the air outlets 36 could have any desired form, including, for example, a set of circular holes arranged in an annular array; an arrangement of one or more concentric annular slots; or a combination of circular holes and annular slots or slot segments. The air outlets 36 together are to provide the necessary air flow to levitate the drop 28.

Preferably, the viscosity and/or surface tension properties of the fluid are optimized to facilitate the stable levitation thereof. Generally, increasing viscosity and/or surface tension improves the stability of the levitating drop 28, and reduces the likelihood that the drop 28 will break apart during levitation. Preferably, the fluid has a higher viscosity than pure alcohol. More preferably, the fluid may have a viscosity and/or a surface tension at least equal to that of water and, more preferably, greater than the viscosity and/or a surface tension of water. Preferred fluids as hand cleaning fluids include liquid soaps and alcohol gels such as PURELL™ and Alco-Gel™ hand cleaners. As well, ozonized water may be used as the hand cleaning fluid, that is, water containing ozone gas in a sufficiently high concentration to disinfect the hands. Suitable fluids and composition for the fluids can be determined by empherical calculation and or by simple experimentation.

Figure 9A:
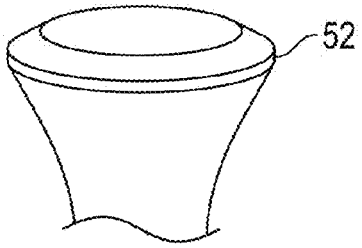
FIGS. 9A, 9B and 9C show alternate shapes for an outer shell of the levitating device shown in FIG. 9.
Figure 9B:
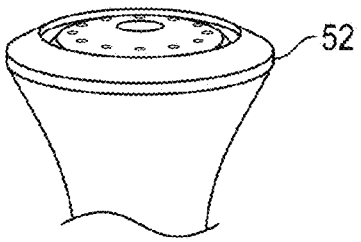
Figure 9C:
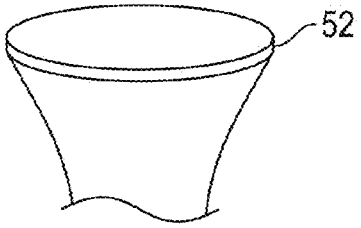
Figure 9:
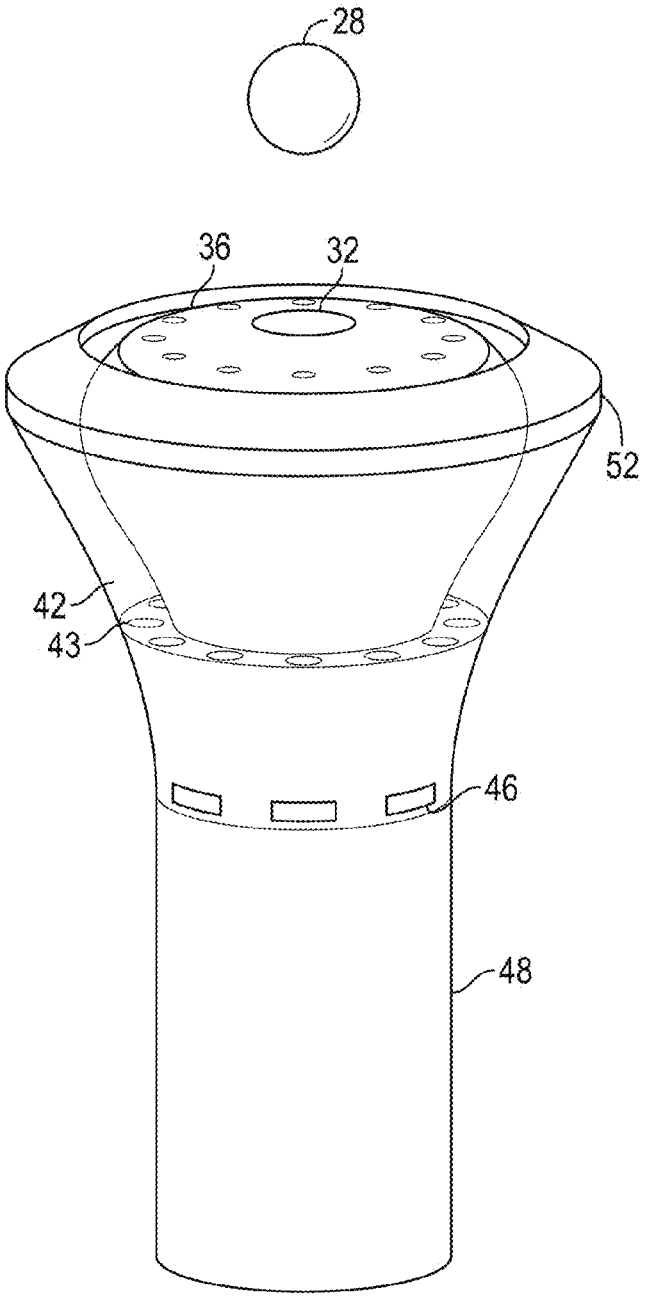
FIG. 9 shows a perspective view of a levitating device in accordance with a third preferred embodiment of the invention.

A further alternate construction of the levitating device 24 in accordance with a third preferred embodiment of the invention is shown in FIG. 9, wherein like numerals are used to represent like components. This construction of the levitator device 24 incorporates an annular trap 42 for collecting unused hand cleaner. In particular, in a preferred manner of operation, if the drop 28 is not taken after a predetermined amount of time, the air pump 22 is turned off, with the drop 28 will fall back down onto the levitator device 24. The levitator device 24 has a curved top surface which directs the unused hand cleaner into the trap 42. The hand cleaner can then be drained away and disposed of, for example, through a drainage channel 43. Optionally, the device 24 could incorporate a self-cleaning function wherein water is periodically discharged into the levitation device to wash any unused hand cleaner collecting in the trap 42 down the drainage channel 43. For example, water from a water source could be delivered via a water delivery tube, not shown, to a levitation device a water outlet of the dispenser outlet 32 to wash the unused hand cleaner collecting in the trap 42 down the drainage channel 43. As another example, water from a water source could be delivered via the dispenser outlet 32 to wash the unused hand cleaner collecting in the trap 42 down the drainage channel 43.

In some embodiments of the invention, the air outlets 36 are configured to alter the shape of the air cushion, for example, by reducing the air flow on one side of the ring, so as to direct the falling drop 28 toward the trap 42 and away from the dispenser outlet 32 and air outlets 36. This helps to prevent the air outlets 36 and the dispenser outlet 32 from getting clogged with unused hand cleaner fluid. In other embodiments, the air outlets 36 and/or dispenser outlet 32 are configured to expel a blast of air that launches the unused drop 28 into a nearby sink 14. In addition to saving energy, limiting the amount of time that a drop 28 is levitated before being discarded can help avoid a loss of efficacy (such as from alcohol evaporation), and help prevent any contamination which might occur if the drop 28 is exposed to the external environment for an extended period of time.

In FIG. 9, the device 24 has a clear outer shell 52 which surrounds the waste trap 42. Several alternate shapes of the outer shell 52 are shown in FIGS. 9A, 9B and 9C, including in FIG. 9A, a relatively closed arrangement; in FIG. 9B, a partially open arrangement; and in FIG. 9C, a fully open arrangement. In some embodiments of the invention, the outer shell 52 is removable and replaceable, so that any available shape could be selected as desired. In addition to aesthetic reasons, the outer shell 52 could also be selected for functional reasons, such as the extent to which a given shape protects the levitating drop 28 from the air currents that are present in the particular environment where the device 24 is installed.

A set of LED lights 46 are also provided to illuminate the levitating drop 28 and/or to create a light display for drawing attention to the device 24. The device 24 furthermore has a rotating head 48, capable of full 360 degree motion, for further attracting attention thereto. Optionally, a color dye can be added to the hand cleaner fluid to increase the visibility of the levitating drop 28. Reflective particles could also be added to create a sparkling effect when light is directed onto the drop 28.

Figure 10:
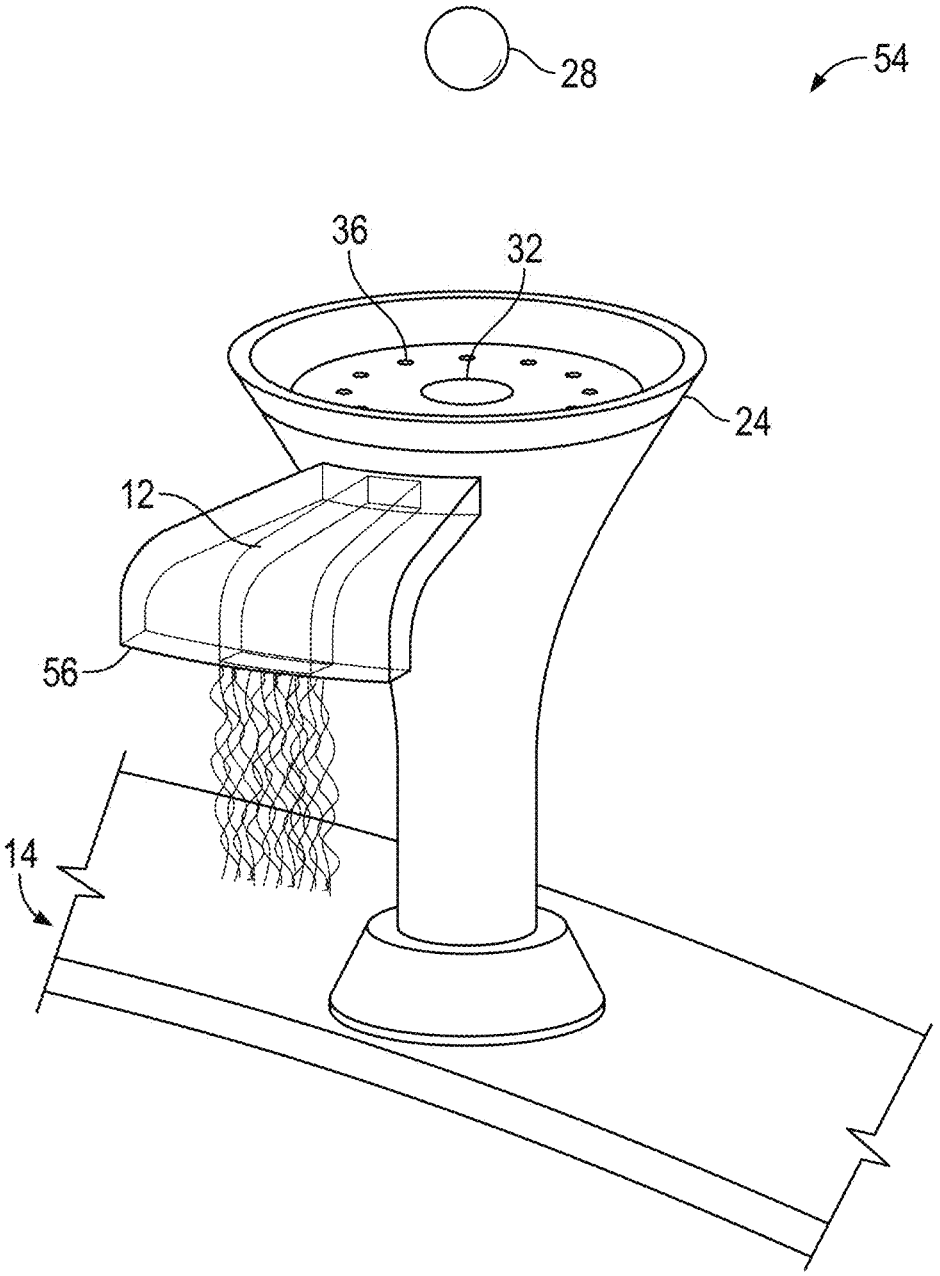
FIG. 10 shows a perspective view of a hand cleaning assembly in accordance with a fourth preferred embodiment of the invention.
Figure 11:
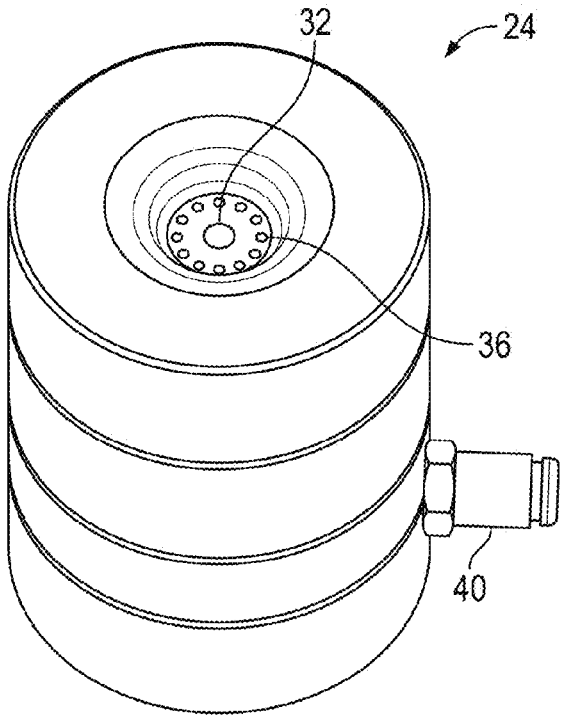
FIG. 11 shows a perspective view of a levitating device in accordance with a fifth preferred embodiment of the invention.
Figure 12:
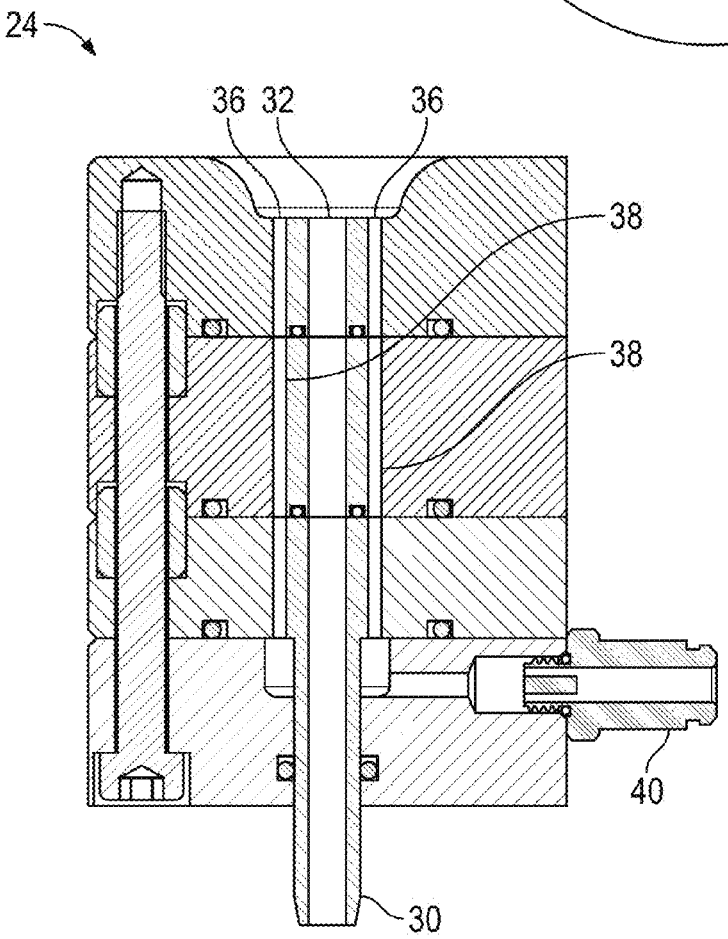
FIG. 12 shows a cross-sectional view of the levitating device shown in FIG. 11.
Figure 13:
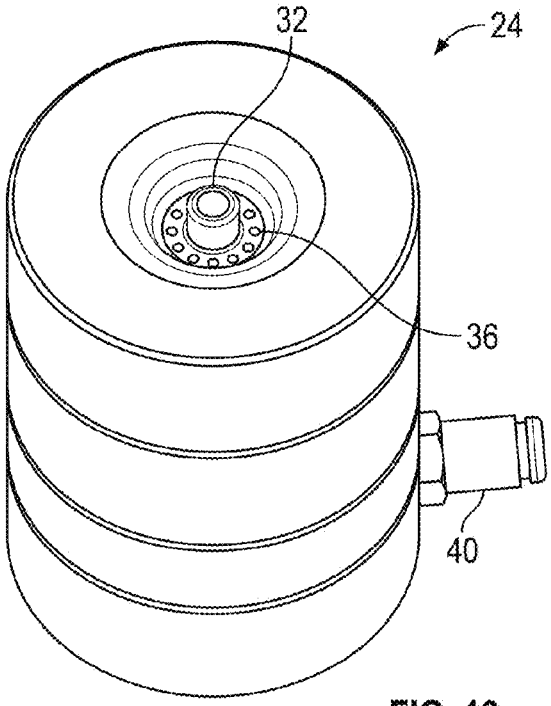
FIG. 13 shows a perspective view of a levitating device in accordance with a sixth preferred embodiment of the invention.
Figure 14:
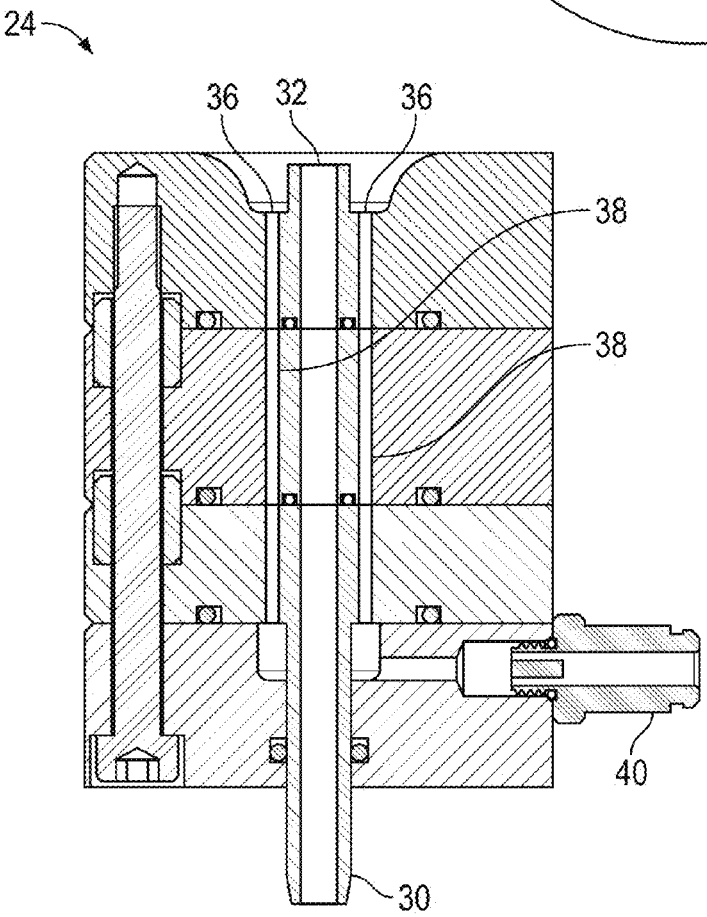
FIG. 14 shows a cross-sectional view of the levitating device shown in FIG. 13.
Figure 32:
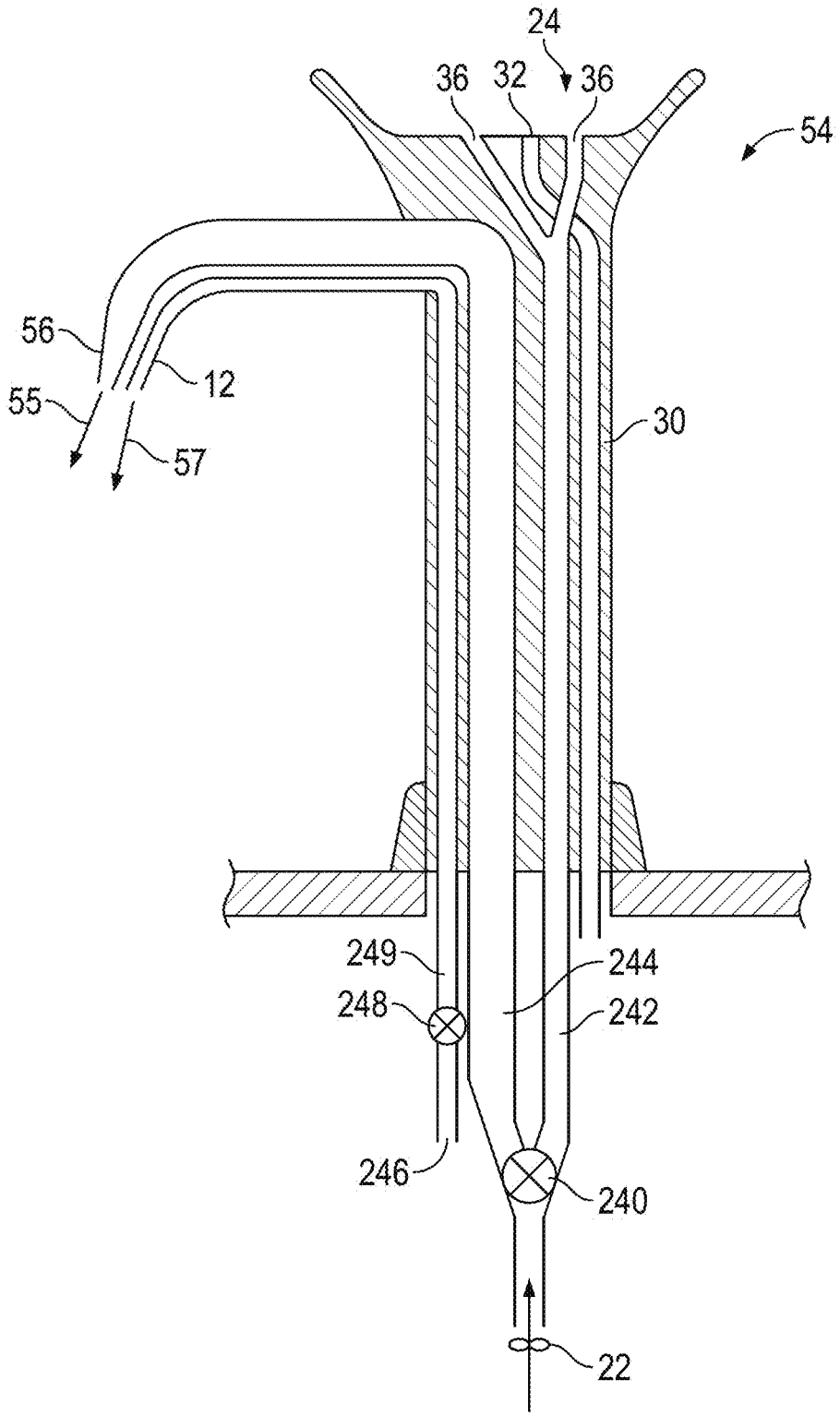
FIG. 32 is a cross-sectional right side view of the hand cleaning assembly of FIG. 10.

A hand cleaning assembly 54 in accordance with a fourth preferred embodiment of the invention is shown in FIGS. 10 and 32, wherein like numerals are used to represent like components. In this embodiment, the levitator device 24 is combined with a faucet 12 and a hand air drying mechanism 56 in a single integrated assembly 54. The multifunctional assembly 54 permits hand washing, rinsing, and drying to be performed at a single, convenient location above a sink 14.

As in the previous embodiments, the levitator device 24 discharges and levitates a drop 28 of hand cleaner fluid at a height where it can be easily seen and taken by a user's hand. The discharge and levitation of the drop 28 can be triggered, for example, by a sensor which detects the user approaching the sink 14. The assembly 54 preferably detects when the drop 28 has been taken by the user, and automatically activates the water faucet 12 to discharge from the water faucet outlet 13 a stream of water 57 for rinsing the user's hands. Next, the hand air drying mechanism 56 is automatically activated to discharge from an air knife air outlet a stream of air 55, preferably a high velocity stream of air, so that the user may conveniently dry his or her hands over the sink 14 by the air stream entraining and removing water on the user's hands. The assembly 54 could also be automated to provide soap, water and air in a timed sequence, such as first providing a rinse phase where water is dispensed from the faucet 12, followed by a scrub phase where the drop 28 of hand cleaner is discharged and levitated, and then a second rinse phase followed by a final drying phase. The assembly 54 could also be configured to accept user commands, such as voice commands or motion commands, to control the various functions thereof. Each of the levitation device 24 and the hand air drying mechanism 56 could have its own independent air delivery device. Preferably, an air delivery device 22 such as, for example, an air fan, could be provided to deliver a stream of pressurized air, and a switching or valve mechanism 240 is provided to selectively deliver the stream of pressurized air to a conduit 242 leading to the levitation device 24 or a conduit 244 leading to the hand air drying mechanism 56. Water from a water source 246 is delivered via a water tube 249 to the faucet 12 as controlled by a control valve 248.

A series of further alternate constructions of the levitator device 24 in accordance with fifth, sixth, and seventh preferred embodiments of the invention are shown in FIGS. 11 to 16, wherein like numerals are used to represent like components. These embodiments illustrate various modifications that may be made to the device 24 to enhance the functionality thereof. For example, the device 24 shown in FIGS. 13 and 14 incorporates a dispenser outlet 32 that is raised above the ring of air outlets 36. This configuration helps to ensure that the discharged drop 28 of hand cleaner is expelled at a sufficient height above the air cushion so as to be gently lifted and levitated thereby.

Figure 15:
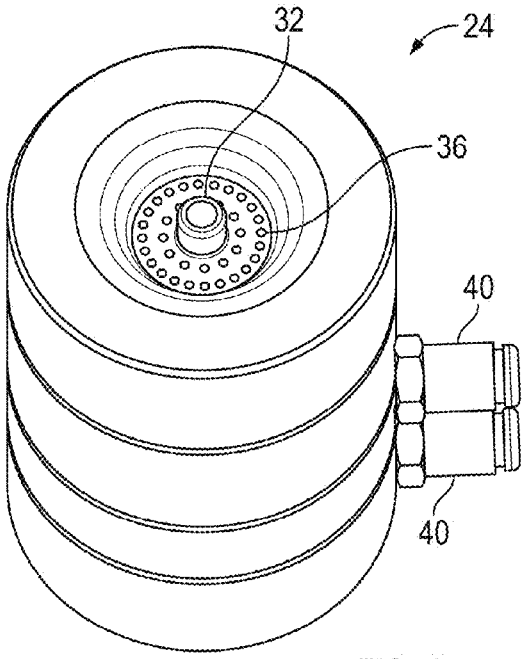
FIG. 15 shows a perspective view of a levitating device in accordance with a seventh preferred embodiment of the invention.
Figure 16:
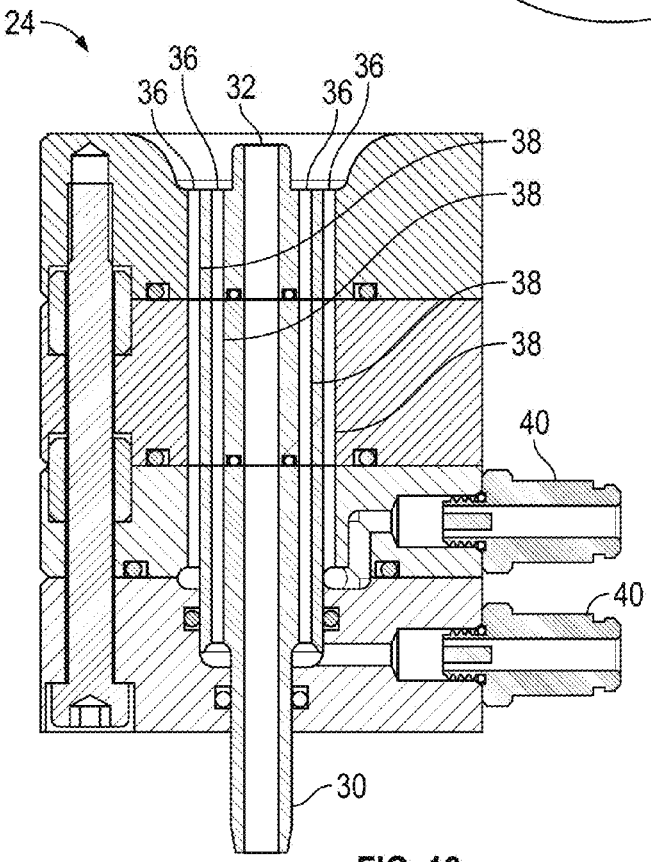
FIG. 16 shows a cross-sectional view of the levitating device shown in FIG. 15.

In the embodiment shown in FIGS. 15 and 16, an additional ring of air outlets 36 has been added. By increasing the number of air outlets 36, the properties of the air cushion can be further improved and controlled. For example, by discharging air from the outer ring of air outlets 36 at a higher velocity than the inner ring, the air cushion can be shaped to more stably hold the drop 28 in the center thereof. With a greater number of air outlets 36, it also becomes possible to dynamically alter the shape of the air cushion during levitation, by independently controlling the velocity of the air that is expelled from individual air outlets 36 or sets of air outlets 36. This can be used, for example, to move the levitating drop 28 along a path, such as a circle or FIG. 8, which may further attract attention to the levitating drop 28.

Figure 17:
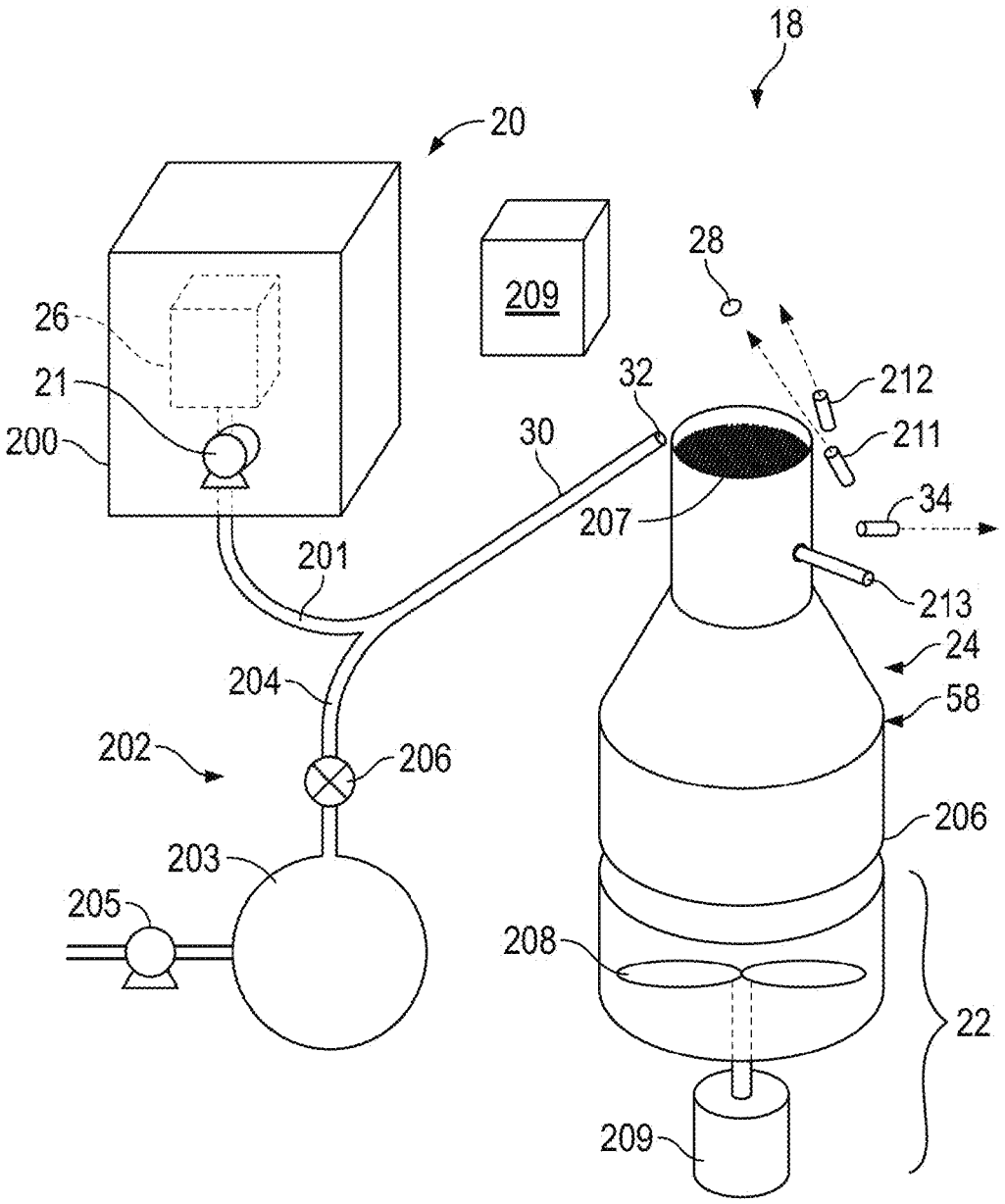
FIG. 17 shows a schematic pictorial view of a dispenser assembly in accordance with an eighth embodiment of the present invention.
Figure 18:
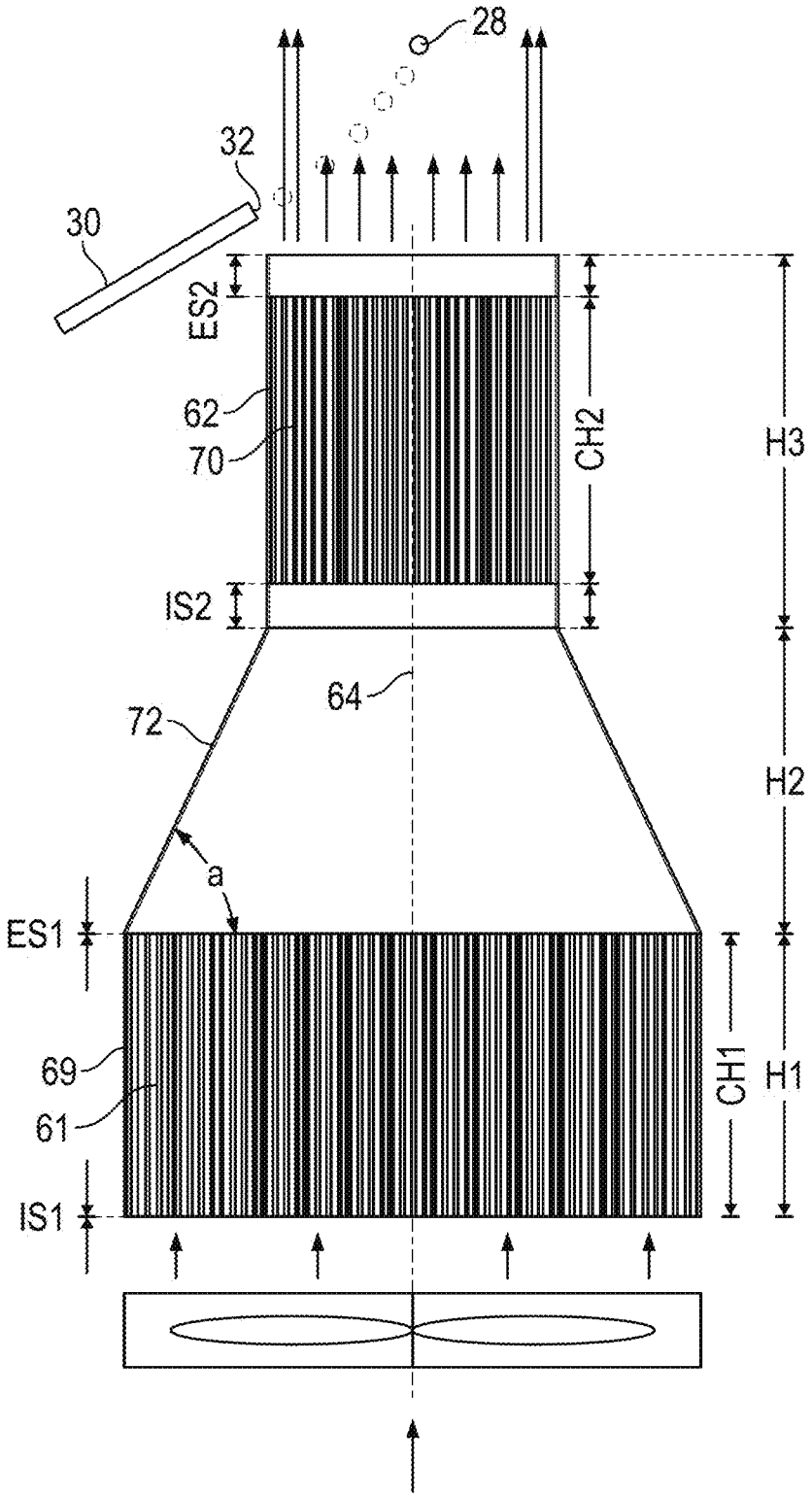
FIG. 18 is a schematic cross-sectional side view of the air profile generator in Figure along section line A-A' in FIG. 17.

Reference is made to FIGS. 17 to 25 showing an eighth embodiment of a fluid dispenser 18 in accordance with the present invention. As seen in FIGS. 17 and 18, the fluid dispenser 18 includes a drop discharge mechanism 20 and a levitator device 24.

The levitator device 24 includes an air delivery device 22, and an air profile generator 58. The air delivery device 22 is shown as a fan 208 driven by an electric motor 209 within a fan shroud 210. Pressurized air is delivered by the air delivery device 22 to an inlet 206 to the air profile generator 58 and passes through the air profile generator 58 and out an exit 207 of the air profile generator 58 as air flow with a profile that creates an air cushion to levitate a fluid drop 28.

The drop discharge mechanism 20 discharges a drop 28 of fluid through the delivery tube 30 and out the discharge outlet 32. As seen schematically in FIG. 18, the outlet line 30 is shown to discharge a drop 20 at a velocity out of the dispenser outlet 32 directed radially into the air flow from the air profile generator 58 such that the drop 20 may move radially to a position in which the air flow from the air profile generator 58 levitates the drop.

FIG. 17 schematically shows the drop discharge mechanism 20 as including a dispenser 200 with a fluid reservoir 26 and an electric pump 21 to dispense a single dose of fluid through a plug discharge tube 201 in a manner as, for example, disclosed in U.S. Pat. No. 8,684,236 to Ophardt, issued Apr. 1, 2014, the disclosure of which is incorporated herein by reference, such that the dose exits as a plug of fluid filling the discharge tube 201 over a short length between both a upstream plug of air filling the discharge tube 201 upstream from the liquid plug and a downstream plug of air downstream of the plug of fluid open to the discharge outlet 32. An air canon device 202 is provided having a vessel 203 containing pressurized air connected via an air burst discharge tube 204 to the plug discharge tube 201. The air burst discharge tube 204 and plug discharge tube 201 merge into the delivery tube 30 leading to the discharge outlet 32. An air replenishing pump 205 is provided to keep the pressure of air within the vessel 203 within desired pressure ranges. An air burst valve 206 is between the vessel 203 and the delivery tube 30. The air burst valve 206 is controllable to be open or closed.

In operation, the dispenser 200 discharges a plug of fluid through the plug discharge tube 201 into the delivery tube 30 and, once the plug of fluid is in the delivery tube 30, the air burst valve 206 is quickly opened and then closed to deliver pressurized air from the vessel 203 through the air burst discharge tube 204 and into the delivery tube 30 upstream from the plug of fluid in the delivery tube 30. The pressurized air pushes the plug of fluid through the delivery tube 30 and out the dispenser outlet 32 at a suitable discharge velocity. The plug of fluid on discharge out the dispenser outlet 32 into the air forms into the drop 28.

FIG. 17 also schematically shows various sensors useful to control operation of the hand cleaning fluid dispenser 18. Referring to FIG. 17, the dispenser assembly 18 is schematically includes a number of sensors 34, 211, 212 and 213 towards providing inputs to a control mechanism 209 to operate and control the dispenser assembly 18. In FIG. 17, a person sensor 34 is provided to sense if a person is proximate to the dispenser assembly 20 and, preferably, to determine if a person is sufficiently close that the person may be able to reach a levitated drop with their hand or, if a person is at a distance, that the person may be attracted to the dispenser assembly 18 as by levitating a drop. A drop sensor 211 is provided to sense if a drop 28 is being levitated. A hand sensor 212 is provided to sense if a person's hand is passed through the locations where a drop 28 would be levitated towards providing an indication if a drop 28 may have been grasped by a user's hand. An air flow sensor 214 is provided to sense if there is air flow through the air profile generator 58 and, preferably, whether the air flow may be at a flow rate adequate for levitation.

Figure 19:
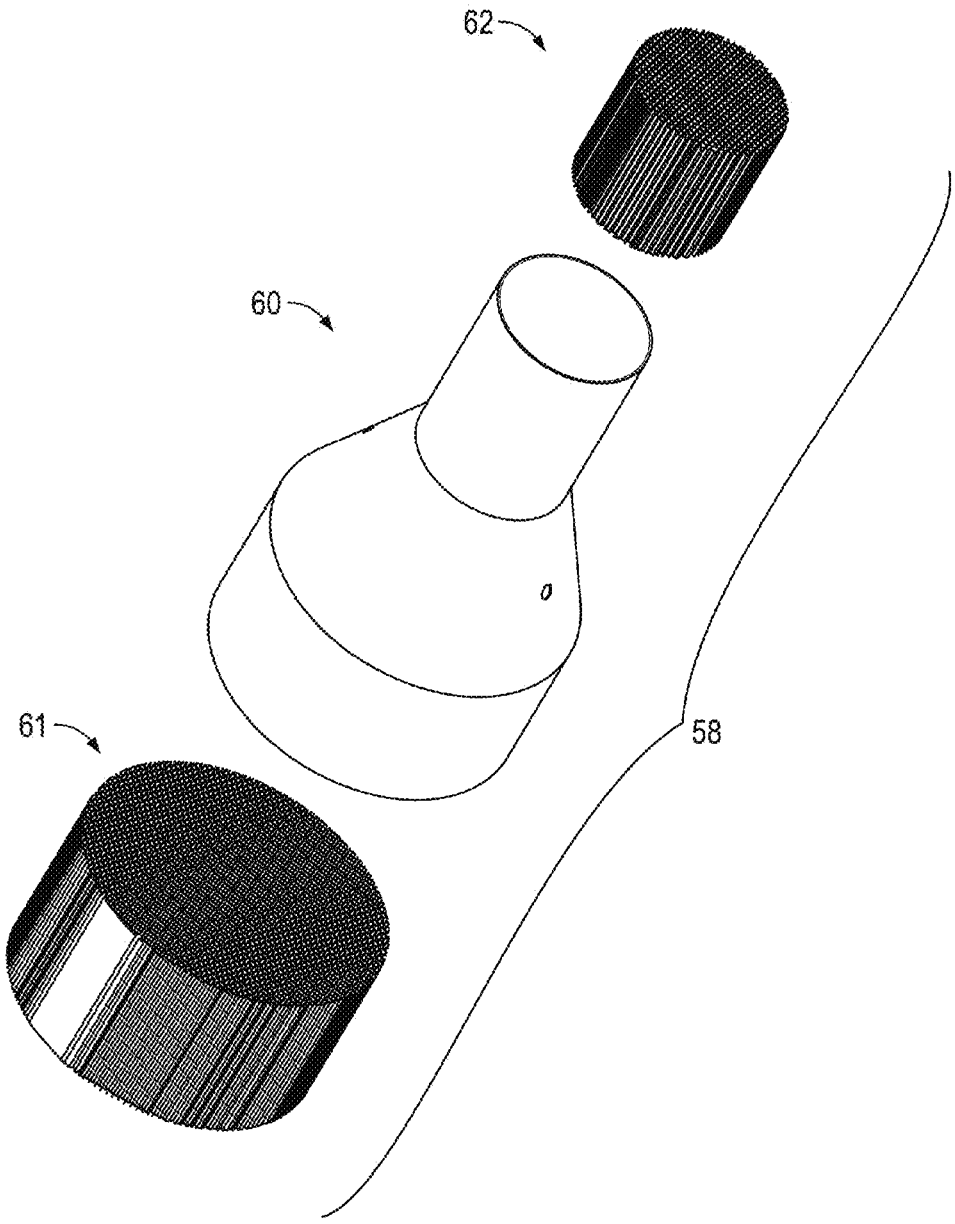
FIG. 19 is an exploded perspective view of the air profile generator of FIG. 18.
Figure 20:
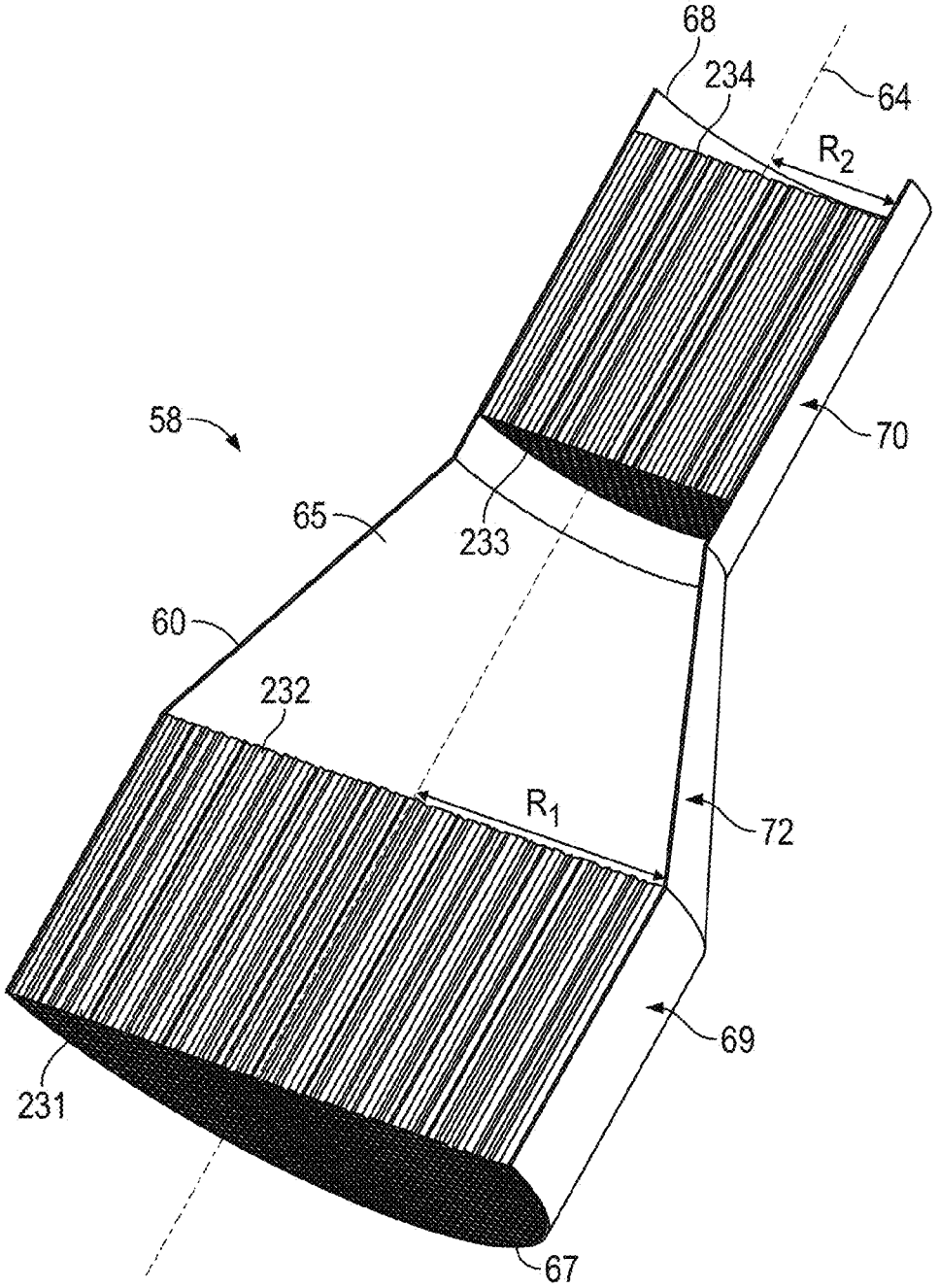
FIG. 20 is a cross-sectional view of the air profile generator of FIG. 18 along section line A-A' in FIG. 17.

As seen in FIG. 19, the air profile generator 58 includes a tubular air guide 60, an upstream air flow collimator 61 and a downstream air flow collimator 62. As best seen in FIG. 20, the air profile generator 58 and its tubular air guide 60 are each coaxial about an axis 64. The tubular air guide 60 has a radially inwardly directed interior wall 65 coaxial about the axis 64. The air guide 60 is open at each of its axial ends to an air inlet 67 at an upstream end and to an air outlet 68 at a downstream end. The air guide 60 has a cylindrical upstream portion 69 over which the interior wall 65 is of a first radius R1 about the axis 64 and a cylindrical downstream portion 70 over which the interior wall 65 is of a second radius R2 about the axis 64 smaller than the first radius R1. The air guide 60 also has an intermediate reducing portion 72 bridging between the upstream portion 69 and the downstream portion 70. Over the reducing portion 72, the radius of the interior wall 65 reduces gradually from the first radius R1 of the upstream portion 69 to the second radius R2 of the downstream portion 70 with proximity to the downstream portion 70. In the ninth embodiment, the reducing portion 72 is shown to be frusto-conical, however, while this is preferred, it is not necessary.

Figure 21:
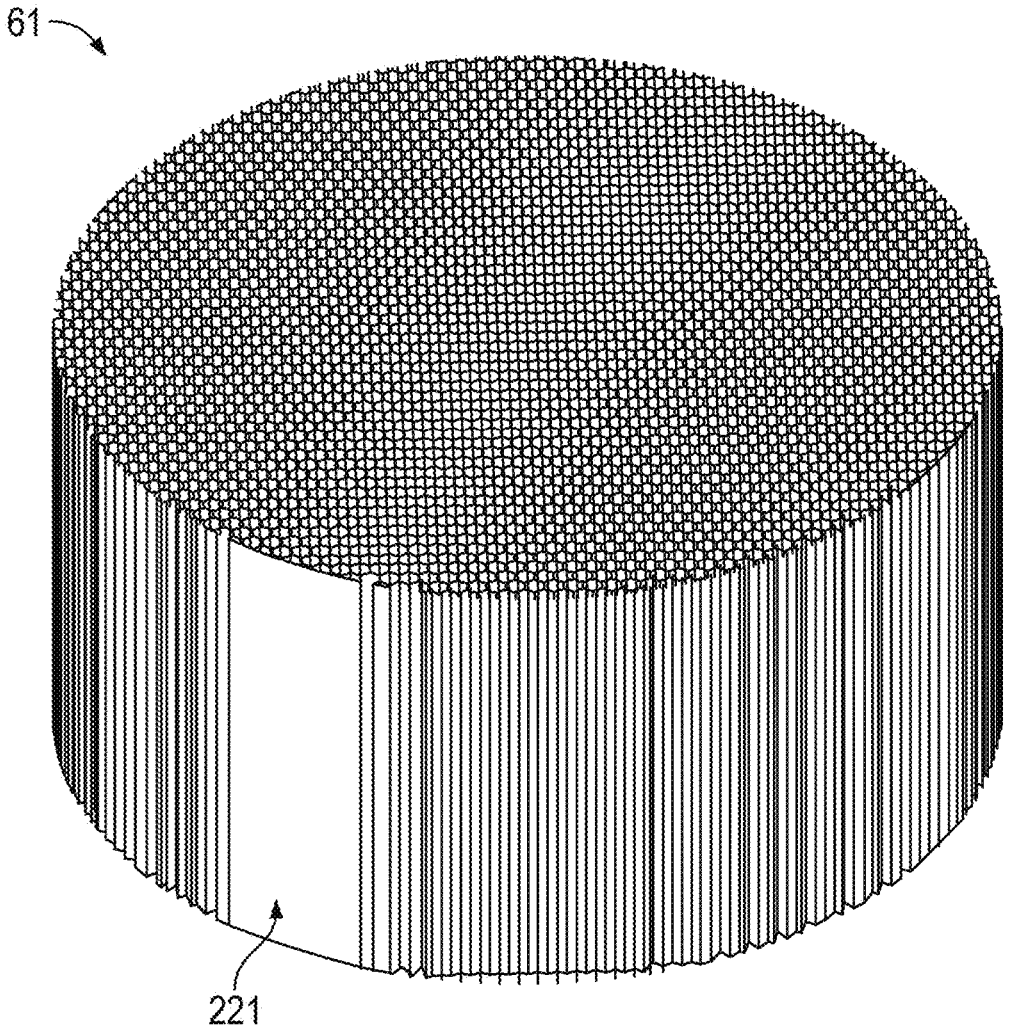
FIG. 21 is an enlarged pictorial view of the upstream air flow collimator of FIG. 19.
Figure 22:
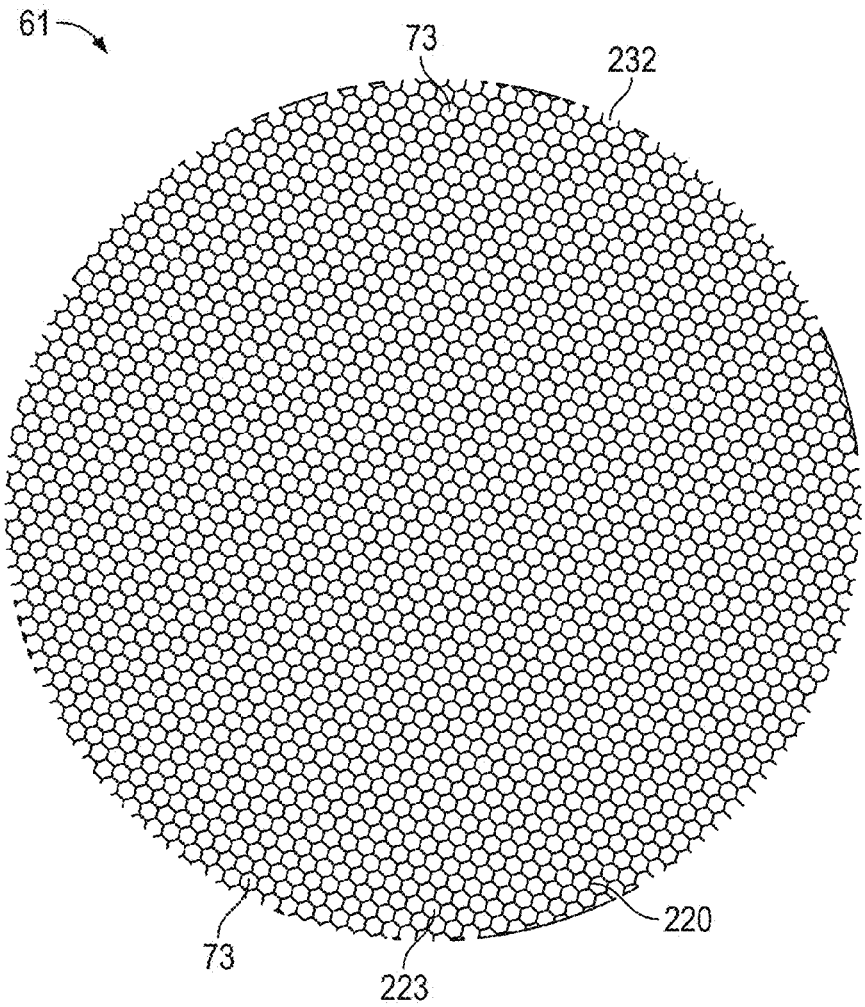
Figure 23:
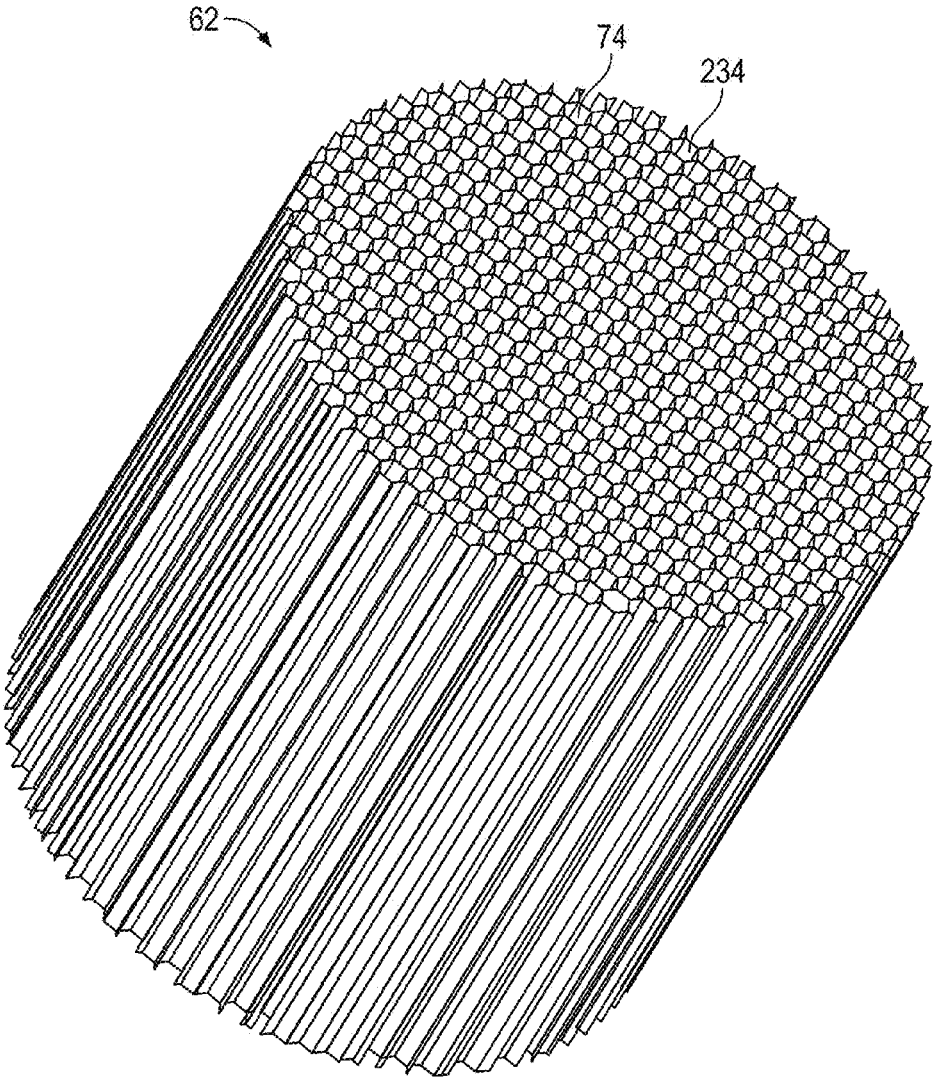
FIG. 23 is a pictorial view of the downstream air flow collimator of FIG. 19.
Figure 24:
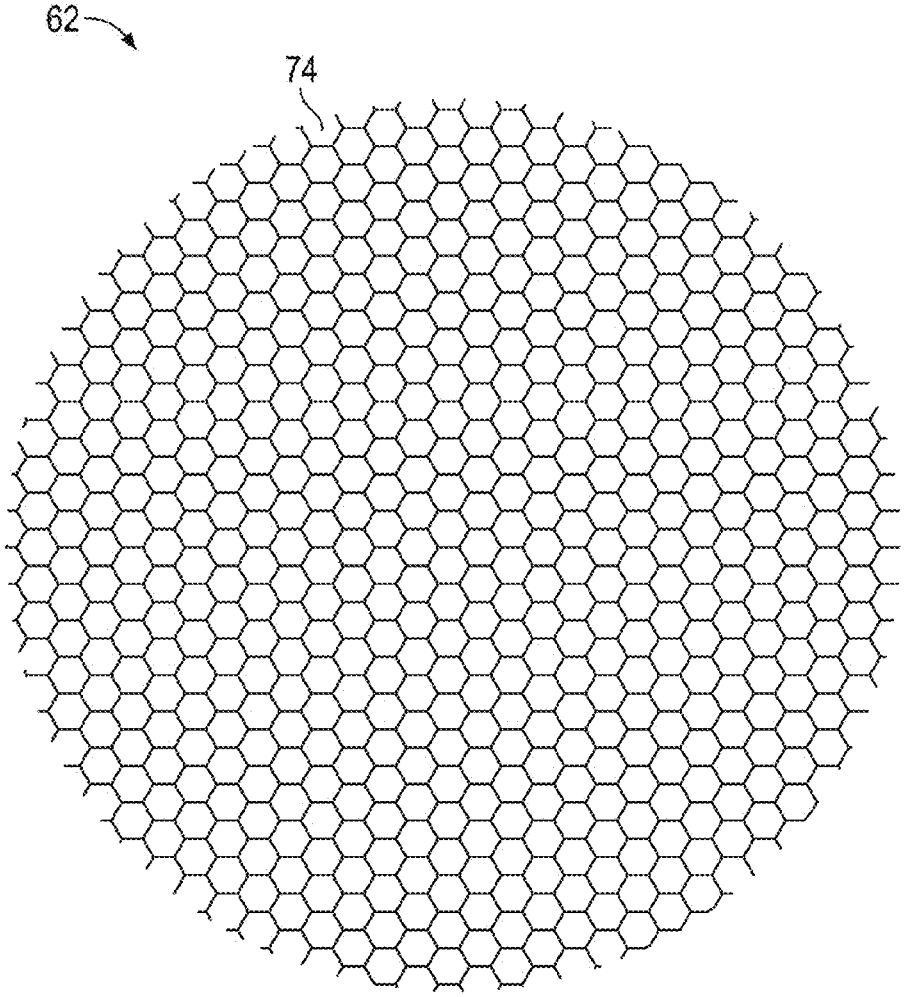
FIG. 24 is a top view of the downstream air flow collimator of FIG. 23.

The upstream air flow collimator 61 is best seen in pictorial views in FIGS. 19 and 21 and in top view in FIG. 22. The upstream air flow collimator 61 provides a plurality of parallel straight-through upstream passageways 73 for air flow. Each upstream passageway 73 extends parallel to the axis 64. Each upstream passageway 73 is open at both axial ends, that is, open both at an axial upstream inlet end 231 of the upstream air flow collimator and an axially downstream exit end 232 of the upstream air flow collimator 61. In the preferred embodiment as illustrated, the upstream air flow collimator is formed with a honeycomb construction providing each of the passageways 73 to be hexagonal in cross-section with each of its side walls 233 forming an adjacent side wall of an adjacent passageway 73. The upstream air flow collimator 61 is seen as a plug of the honeycomb material which has cylindrical outer surface 221 engaged with the wall 65 of the cylindrical up stream portion 69 of the air guide 60. As seen in FIG. 18, the upstream air flow collimator 61 is shown to provide the upstream inlet ends 231 of the passageways 73 in an upstream plane normal to the axis 64 and the downstream exit ends 232 of the passageways 73 in a downstream plane also parallel the axis 64. Providing the upstream inlet ends and the downstream exit ends of the passageways 73 to be in the same plane normal the axis 64 is not necessary and these ends may be provided in other planes normal the axis 64 such as, for example, frusto-conical about the axis 64, or otherwise varying with radial distance from the axis 64.

The downstream air flow collimator 62 is shown to be substantially identical to the upstream air flow collimator 61 as a cylindrical plug of honeycomb material which closely engages the wall 65 within the cylindrical downstream portion 70 of the air guide 60. The downstream air flow collimator 62 has a plurality of parallel straight-through downstream passageways 74 for air flow. Each downstream passageway 74 extends parallel to the axis 64. Each downstream passageway 74 is open axially at each of its ends, that is, open axially at an upstream inlet end 233 and open axially at a downstream outlet end 234. The inlet ends 233 of the downstream passageways 74 are shown to lie in a flat plane normal to the axis 64. The exit ends 234 of the passageways 74 are shown to lie in a flat plane normal to the axis 64. This is not necessary and the inlet and outlet ends of the passageways 74 may be provided in other configurations such as with varying axial position relative to the distance from the axis 64, for example, to be frusto-conical. The center of any frusto-conical portion of the plane containing the inlet ends or exit ends of either the passageways 73 or 74 may be disposed either axially downwardly or axially upwardly relative the remainder of the cone.

FIG. 18 schematically illustrates the levitator device 24 as having the air delivery device 22 for delivering a stream of pressurized air to the air inlet 67 of the air guide 60 for passage of the air through the upstream air flow collimator 61 via its passageways 73, through the reducing portion 72 constrained by the interior wall 65 and through the downstream air flow collimator 62 to exit from the air outlet 68 of the tubular air guide 60.

On FIG. 18, the drop 28 is shown as being ejected at a velocity out of the dispenser outlet 32 to adopt the path as shown with the drop in broken lines into a levitating air cushion provided by the air being discharged from the outlet of the air guide 60. On FIG. 18, two drops 28 are shown one in solid lines and the second in broken lines to schematically illustrate upper and lower limits of a suitable range of heights at which the drop 28 may be levitated above the levitator device 24 at heights and positions where the drop 20 is accessible to be grasped by a hand of a user.

Figure 25:
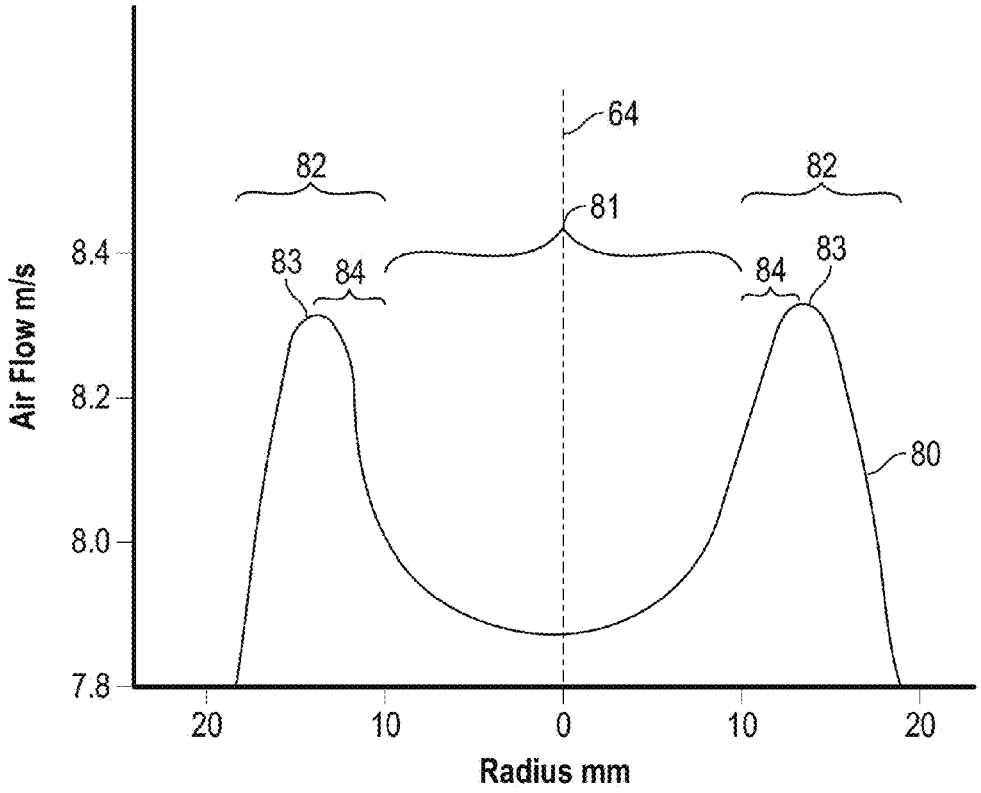
FIG. 25 is a chart showing at the exit of the levitation device of FIG. 17 along section line A-A' on FIG. 17 the velocity of the air flow in meters per second relative to the radial distance from a center axis.

Reference is made to FIG. 25 which shows a chart measuring at the air outlet 68 of the tubular air guide 60 of FIG. 18, the velocity of the air flow in meters per second relative to the radial distance from the axis 64 as measured in the vertical cross-sectional plane A-A' in FIG. 17 including the center axis 64. As can be seen in FIG. 25, the upwardly directed flow of air has a velocity profile 80 disposed about the axis 64 with a center portion 81 and an annular portion 82 annularly relative the axis about the central portion 81. Over the central portion 81, the flow of air has a velocity adequate to levitate the drop 20 above the central portion 81. Over the annular portion 82, the velocity is greater than the velocity over the central portion 81. The velocity profile 80 shown in FIG. 25 would appear substantially the same in any vertical plane including the axis 64 at any rotational position about the axis 64.

As can be seen on FIG. 25, the annular portion 82 has an annular peak 83 representing the highest velocity. The annular portion 82 has an annular shoulder segment 84 between the annular peak 83 and the central portion 81 within which annular shoulder segment 84 the air velocity decreases with a reduction in the radial distance from the axis 64. A drop 28 which is within the annular shoulder segment 84 of the air flow will be directed partially radially inwardly towards the axis 64 as well as vertically upwardly, with the radial component by which the drop is directed moving the drop 28 radially towards the central axis 64 and thus over to the central portion 81.

The velocity of the air flow from the exit 68 of the tubular air guide 60 will decrease with axial distance upwardly from the outlet 68 of the tubular air guide 60. The velocity of the center portion 81 must, on one hand, maintain a minimum velocity in order to keep the drop 28 in a levitated condition. This minimum velocity depends upon the specific material and volume of the drop amongst other factors. The decrease in velocity of air flow in the axial direction of air flow will provide for the drop to be levitated within a range of heights above the air exit 68 of the air guide 60. Each drop is levitated by being maintained above the central portion 81 constrained in respect of radial movement by the velocity profile over the annular shoulder segment 84 and in respect of vertical movement by the decreased velocities over the entire air flow with increased distance of above the exit 68 of the air guide 60.

The chart of FIG. 25 represents experimental data from air flow through an air profile generator as shown in FIG. 18 with the following specifications. The cylindrical upstream portion and of the upstream collimator 61 was 200 ml. The height of the cylindrical upstream portion 69 H1 and the height of CH1 of the upstream collimator was each 100 milliliters. The second radius R2 of the cylindrical downstream portion 70 and the downstream collimator was 100 milliliters. The height CH2 of the downstream collimator 62 was 100 milliliters. The height H2 of the cylindrical downstream portion 70 was 125 millimeters. The inlet spacing IS2 of the downstream collimator 62 from the inlet to the cylindrical downstream portion 70 was 12.5 centimeters and the exit spacing ES2 of the exit of the downstream collimator 62 from the exit of the cylindrical downstream portion 70 was 12.5 millimeters. The height R3 of the reducing portion 72 was 100 millimeters. The upstream collimator 61 has the same height CH1 as the height H1 of the cylindrical upstream portion 69 with the result that the inlet spacing IS1 and the exit spacing ES1 are both equal to zero. An angle A between a plane normal the axis 64 and the frusto-conical side wall of the reducing portion 72 is 65 degrees. The diameter of each of the passageways 73 and 74 was 4 millimeters.

The air profile generator 58 may have many different combination of dimensions. For example, in an air profile generator 58 as shown in FIG. 18, preferred ranges for the diameter of the passageways 73 and 74 are in the range of 0.1 millimeter to 10 millimeters. Ranges for the height CH1 of the upstream collimator 61 are 0 millimeter to 5,000 millimeters and, for the downstream collimator 62, the height CH2 may be in the range of 0 millimeter to 200 millimeters, for example. Ranges for the radius R1 may be in the range of 5,000 to 50 millimeters. Preferred ranges for the second radius R2 is in the range of 10 to 200 millimeters. Preferred ranges for such angles are in the range of 10 degrees to 170 degrees and, more preferably, is 65 degrees.

The levitator device 18 is preferably operated to levitate a fluid droplet of a diameter of in the range of 70 mm to 200 mm, more preferably, 80 mm to 120 mm, more preferably, 80 mm to 100 mm. Preferably, the drop diameter is at least 70 mm and, more preferably, at least 80 mm or 90 mm. Preferably, the drop volumes are in the range of 0.2 ml to 3 ml and, more preferably, in the range of 0.2 ml to 0.7 ml. With exit air velocities from the air profile generator 58 in the range of 6 to 10 meters per second with the fluid being an alcohol hand sanitizer, for example, the PURELL™ and Alco-Gel™ hand cleaners preferred drops have volumes in the range of 0.2 ml to 0.4 ml for alcohol gel hand sanitizers. For liquid hand soaps, preferred drop volumes are between 0.2 ml and 0.5 ml. More preferably, exit air velocities are in the range of 7 to 8 meters per second for typical hand cleaning fluids.

In one preferred method of operation, the dispense assembly is operated to sense the presence of a user and, while the user is present, and the first drop being levitated to conduct a first monitoring to indicate whether or not the first drop is at a height above the levitator within a range of positions where a drop is accessible to be taken by a user's hand. When the monitoring is performed such that while the user is sensed to be proximate the drop to be levitated and a first monitoring indicates that a first drop was at a height above the apparatus within the range of positions where the drop is accessible to be taken by a user followed by conducting of a second monitoring indicating that the first drop is not at a height above the levitator, this series of events can be taken to be assumed as an indication that the first drop was taken by the user's hand. Promptly after the second monitoring indicating that the first drop is not present, the apparatus is preferably activated to promptly eject and levitate a subsequent drop, preferably within a tome of not greater than half a second. The apparatus is monitored so as to repeat the steps thus subsequently monitoring whether or not the next subsequent is a height above the levitator and where the monitoring indicates the next drop was levitated above the monitor followed by a second monitoring indicating that the subsequent drop is not above the levitator, then promptly levitating a yet further subsequent drop. These series of steps are preferably repeated until an accumulative volume of the first drop and each subsequent drop represents a pre-determined volume suitable to be grasped by a user's hand for a pre-determined use of the fluid. For example, that an advantageous pre-determined volume of the fluid for use in cleaning the hands has been dispensed. For example, with an alcohol gel type alcohol based hand cleaning fluid and each individual drop of 2 ml, on a user approaching the dispenser assembly and grasping a first drop, after the first drop is monitored as having been sensed, two, three or four additional drops would in quick succession be dispensed such that the user will be inclined to grasp the 3 to 5 drops receiving a total volume of, for example, 0.6 to 1.0 mg. Similarly, for any other hand fluid, the dispensing apparatus may be operated in a manner that, after a first drop has been taken by a user, a quick succession of successive additional drops may be levitated to be taken until an accumulative volume of the fluid has been taken representing a pre-determined volume of liquid suitable for a preferred use. Rather than monitor the presence of a drop being levitated or not, the swiping or movement of the user's hand through where a drop is levitated could be used as an indication that a drop has been taken by a user. Both monitoring of the presence or absence of a levitated drop and he movement of a user's hand could be used toward determining when to discharge and levitate a successive drop.

In accordance with the dispenser devices of the present invention, a drop is levitated for a period of time at a height above the levitator device within a range of positions where the drop is accessible to be taken by a user's hand. Preferably, the range of positions where the drop is accessible to be taken by a user's hand permits a drop to be grasped by the user's hand without the user's hand engaging anything other than the drop and, of course, the atmospheric air within which the drop is levitated. Preferably, therefore, the drop will be levitated at least one and, more preferably, at least two or four centimeters above the dispenser apparatus with the dispenser apparatus providing a free vertical space in the range of 10 to 15 cm within which a user's hand may be moved horizontally through an open space above the dispenser apparatus to grasp a drop without engaging anything other than the drop and the air through which the user's hand is moved. Preferably, the grasping space above the apparatus device will have a height in the range of at least 15 cm, a width of at least 15 cm, more preferably at least 40 cm and a depth measured radially from the drop about a vertical axis of at least about 7.5 cm, more preferably 20 cm. Such a grasping space will be useful to ensure that the user's hand does not engage any matter other than the drop in the air within which it is levitated such that the dispenser apparatus will be touchless and minimizes any cross contamination.

Such that a user may grasp a preferred minimum volume of the fluid to be levitated, the drops of the fluid may be levitated in quick succession to an individual user after it is determined that the user has grasped a first drop. Alternatively, a plurality of drops may be levitated at the same time. A plurality of drops may be levitated, for example, by providing the air cushion to, for example, move the individual drops through a circular pattern so as to minimize the likelihood that the individual drops will engage each other and collate into a drop which either will not be levitated and will, due to the air velocity, disintegrate.

FIGS. 17 and 18 show the introduction of the drop 28 radially into the air flow from the air profile generator 58. However, there are many different manners in which the drop 20 may be suitably located within the air cushion provided by the upwardly flowing air from the air profile generator 58, for example, axially from below or above.

Figure 26:
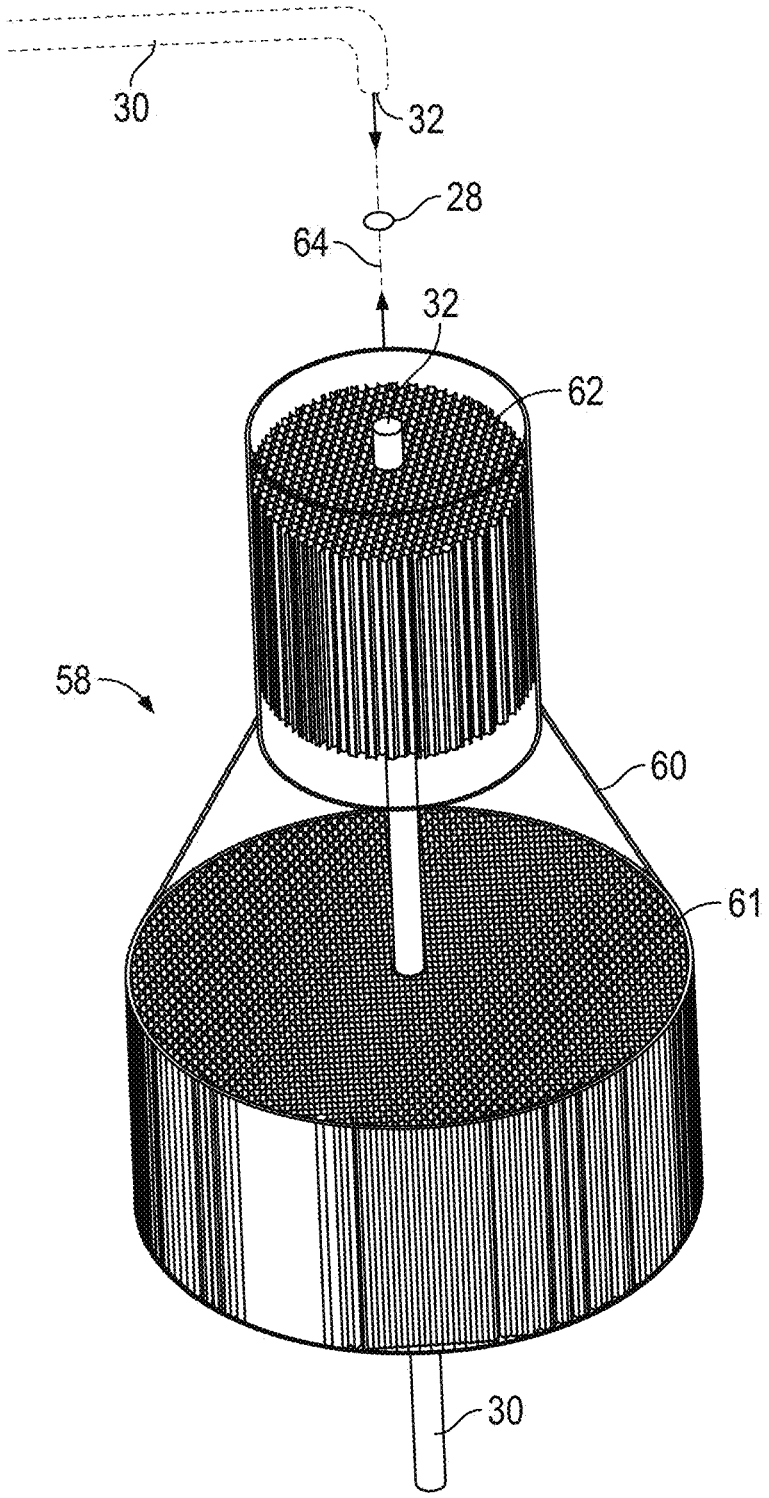
FIG. 26 is a schematic pictorial view of an air profile generator in accordance with a ninth embodiment of the present invention in which a tubular air guide is shown as being transparent to assist in the illustration of a discharge outlet to extend coaxially through the air profile generator.

Reference is made to FIG. 26 which illustrates an air profile generator 58 identical to that in FIG. 19 but for two exceptions. In FIG. 26, the tubular air passage 60 is shown as being transparent for ease of illustration. A first exception is that a first outlet line 30 is shown as being provided to extend coaxially along the axis 64 through each of the upstream collimator 61 and the downstream collimator 62 so as to locate the discharge outlet 32 within the upwardly extending air flow at the outlet end of the tubular air guide 60 and to discharge a drop 28 upwardly into the air flow. A second exception is that FIG. 26 also shows in broken lines an alternate outlet line 30 to dispense the drop 28 from a dispenser outlet 32 disposed coaxially of the axis 64, however, at a height vertically above the outlet of the air guide 60 such that a drop 20 may be discharged to fall vertically downwardly into the levitating air cushion provided by the upward flowing air. The particular manner by which a drop of liquid is directed to become located within the levitating cushion of air is not limited.

Figure 27:
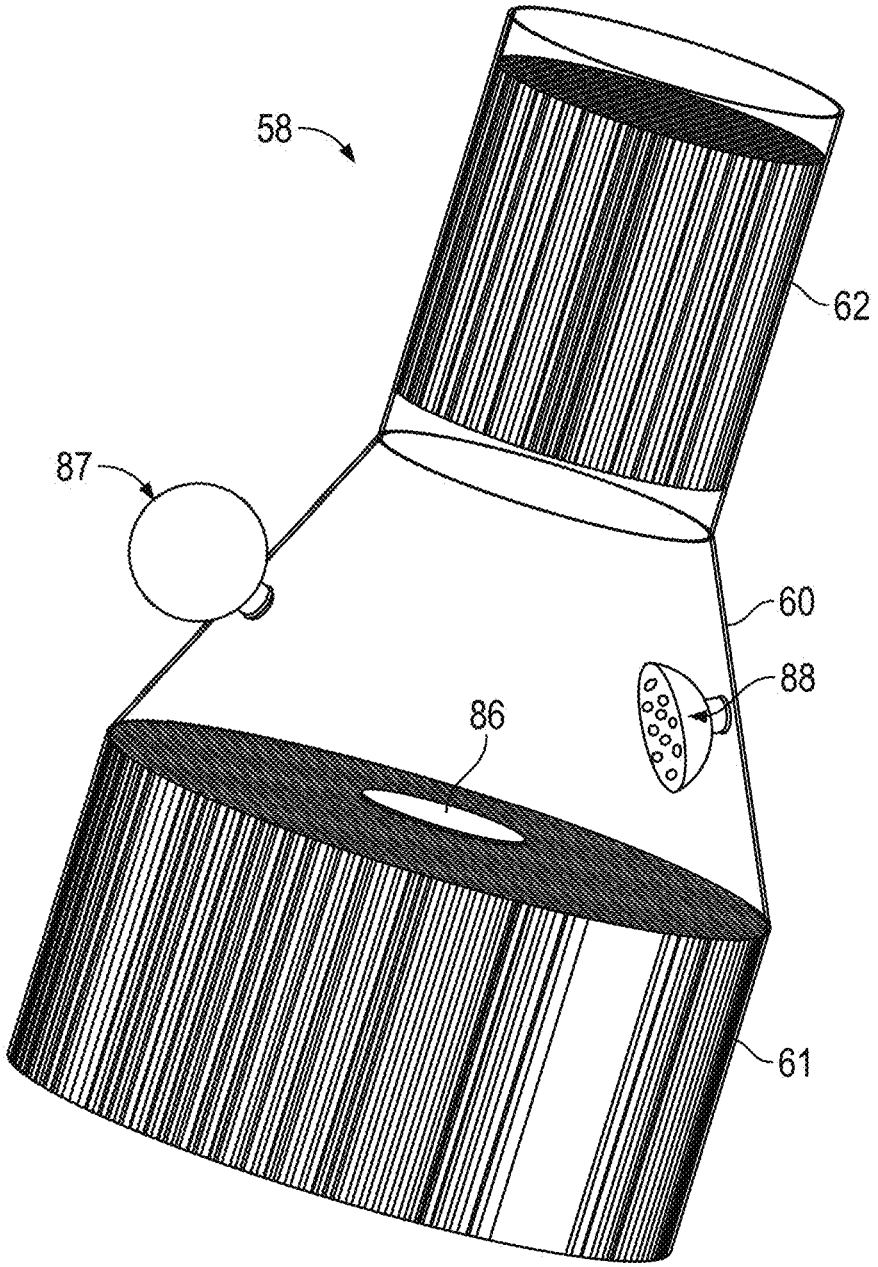
FIG. 27 is a schematic pictorial view showing a tenth embodiment of an air profile generator in accordance with the present invention and in which a tubular air guide is shown as transparent.
Figure 28:
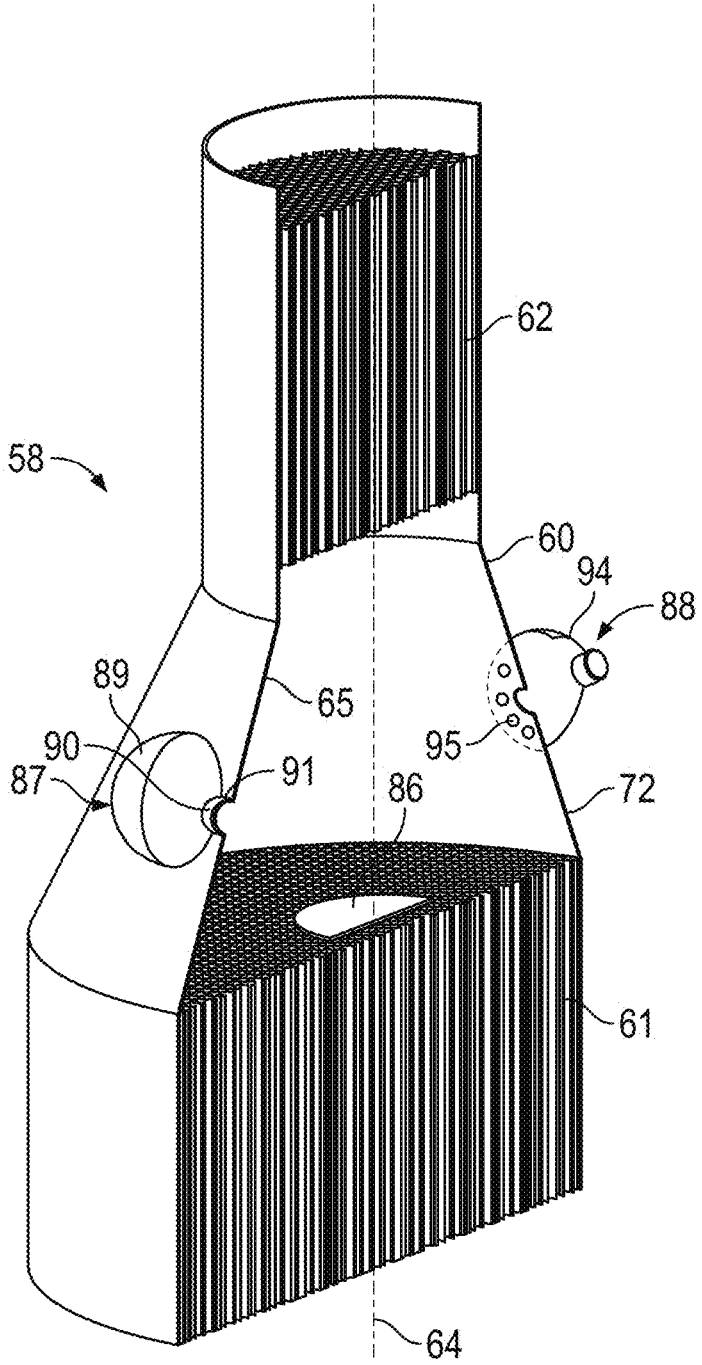
FIG. 28 is a pictorial cross-sectional view of the air profile generator of FIG. 27 along section line C-C' in FIG. 27.

Reference is made to FIGS. 27 and 28 showing a tenth embodiment of an air profile generator 58 in accordance with the present invention. In FIGS. 27 and 28, the tubular air passage 60 is shown as being transparent for ease of illustration. The air profile generator 58 of FIG. 27 is identical to the air profile generator 58 of FIG. 19 but for three exceptions. A first exception is the provision of air flow blocker 86. The second exception is the provision of a pressure dampening mechanism 87. A third exception is the provision of an acoustical dampening mechanism 88.

The air flow blocker 86 comprises a thin circular disc coaxially about the axis 64 which is secured to the exit end 232 of the upstream air flow collimator 61 to stop flow through the passageway 73 covered by the air flow blocker 86. The air flow blocker 86 thus prevents air flow over a selected central circular portion through the upstream air flow collimator 61 as can be advantageous to assist in providing for a reduced velocity over the central portion 81 of the velocity profile. The air flow blocker 86 is illustrated as a circular disc closing the exit ends of selected of the passageways 39, alternate configurations for air flow blockers 86 could be provided at the inlet ends 231 of the passageways 73 of the upstream air flow collimator 61 or within the reducing portion 72 at some distance from the upstream air collimator 61.

The pressure dampening mechanism 87 is provided to dampen changes in air pressure within the air guide 60 and, more preferably, within the reducing portion 72 of the air guide 60. The pressure dampening mechanism 87 is shown as comprising a resilient spherical balloon 89 with a neck 90 that is fixedly secured about an opening 91 through the wall 65 of the air guide 60 into the reducing portion 72. The balloon 89 defines a variable volume compartment 92 in communication with the air within the reducing portion 72. The variable volume compartment 92 is defined within the confining walls of the balloon 89 so as to be resilient in the sense of having a resilient panel with an inherent bias to adopt an inherent condition in which the compartment 92 has an inherent volume. The resilient panel resiliently stretches from its inherent condition to biased conditions in which the compartment 92 adopts biased volumes greater than the inherent volume as the air pressure in the compartment 92 increases. Insofar as there is an increase in air pressure within the reducing portion 72, then this will provide an increase in pressure within the balloon 89 increasing the volume of the balloon 89 which will have an effect of reducing the air pressure within the reducing portion 72. The particular individual balloon 89 illustrated is but a simplified configuration of such an air pressure dampening mechanism 87. The relative volume of the variable volume compartment 92 will have an impact on the extent to which dampening of the air pressure within the air profile generator 58 may be carried out. Individual balloons 89 may have a capability to expand to a relatively substantial volume during normal operational pressures of the air profile generator 58 and, as well, a plurality of such pressure dampening mechanisms 87 may be provided annularly about the air guide 60. Rather than provide external balloons 89 as illustrated in FIG. 27, a similar dampening arrangement could be provided by having an inflatable annular bladder about the reducing portion 72 with a plurality of openings through the wall into the resilient annular bladder.

On FIG. 27, an acoustical dampening mechanism 88 is schematically shown as comprising an acoustical speaker 94 so as to direct sound waves through an array of openings 95 in the wall 65 and into the interior of the air guide 60 preferably into the interior of the reducing portion 72 so as to interfere with and thereby reduce air flow patterns such as standing waves and the like that may arise due to air flow through the air guide 60 the interior of the reducing portion 72.

Figure 29:
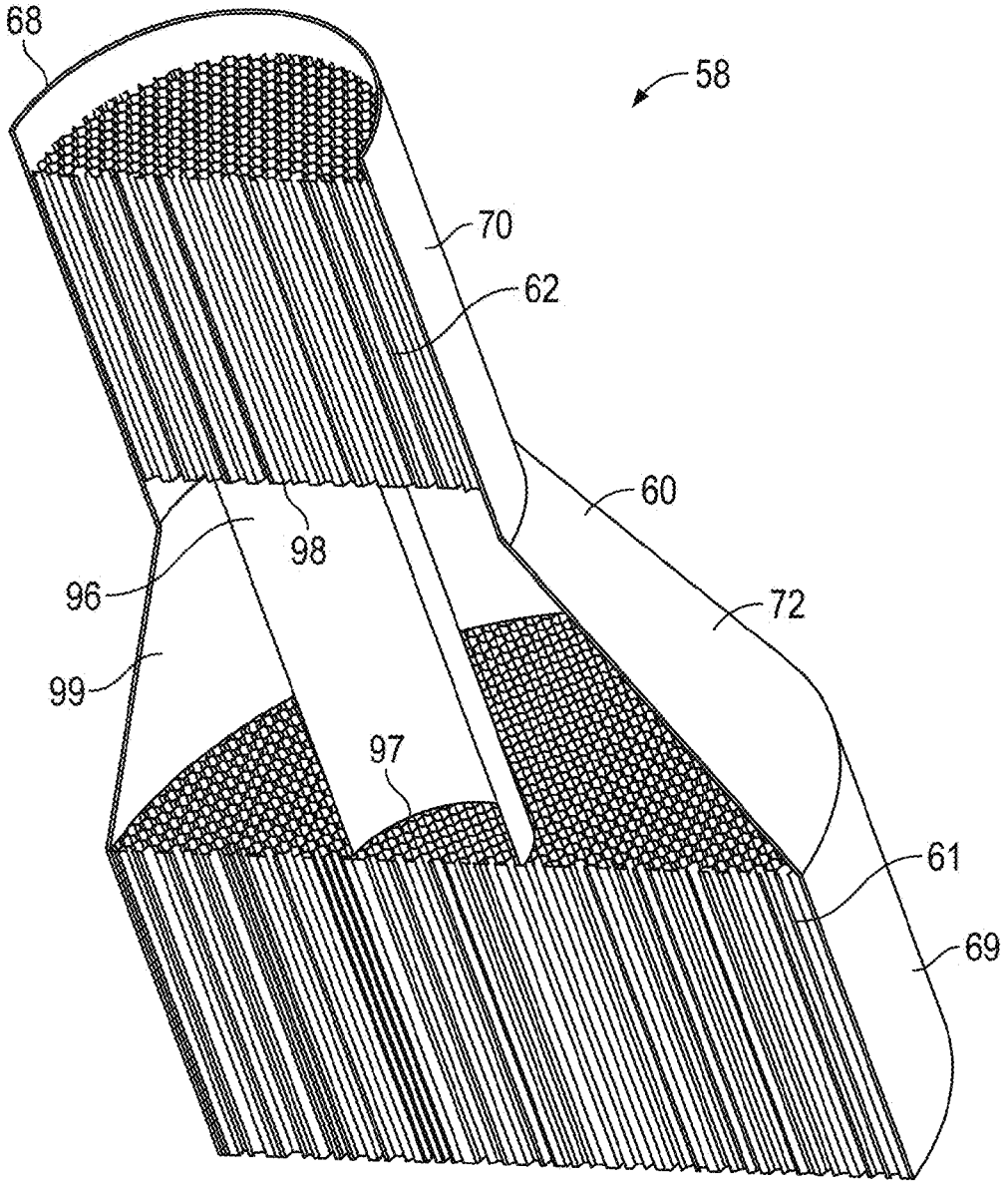
FIG. 29 is a pictorial cross-sectional view of an air profile generator in accordance with an eleventh embodiment of the present invention.

Reference is made to FIG. 29 which illustrates a pictorial cross-sectional view of an air profile generator 58 in accordance with an eleventh embodiment of the present invention which is identical to the air profile generator 58 shown in FIG. 19 but for the inclusion of a cylindrical tubular inner guide tube member 96 with an axially open upstream end 97 and an axially open downstream end 98. The tube member 96 extends axially through reducing portion 72. The tube member 92 is coaxial about the axis 64. The tube member 92 has a radius less than the second radius R2 of the downstream portion 70 so as to define within the air guide 60 annularly about the tube member 92 an annular passage 999 for air flow. As seen in FIG. 29, the tube member 96 extends within the reducing portion 72 between the upstream collimator 61 and the downstream collimator 62. The annular passage 99 for air flow is defined radially outwardly of the tube member 96 and radially inwardly of the wall 65. The cross-sectional area of the annular passage 96 normal to the axis 64 reduces with proximity to the exit end 68 of the air guide 60 thus increasing air pressure within the annular passage 99 proximate the inlet of the downstream collimator 62 and hence giving rise to air flow through the passageways 74 of the downstream collimator 62 that are open to the annular passage 99 to be increased compared to the velocity of air flow through the passageways 74 that receive air flow that passes radially inside the guide tube member 96.

In the first preferred embodiment, the present invention as illustrated in FIG. 19, both an upstream collimator 61 and a downstream collimator 62 are provided. In accordance with the present invention, the provision of the downstream air flow collimator 62 may be eliminated such that an air profile generator 58 may be provided which is the same as that illustrated in FIG. 19 as a further embodiment in which there is provided merely the tubular air guide 60 and the upstream air flow collimator 61.

Figure 30:
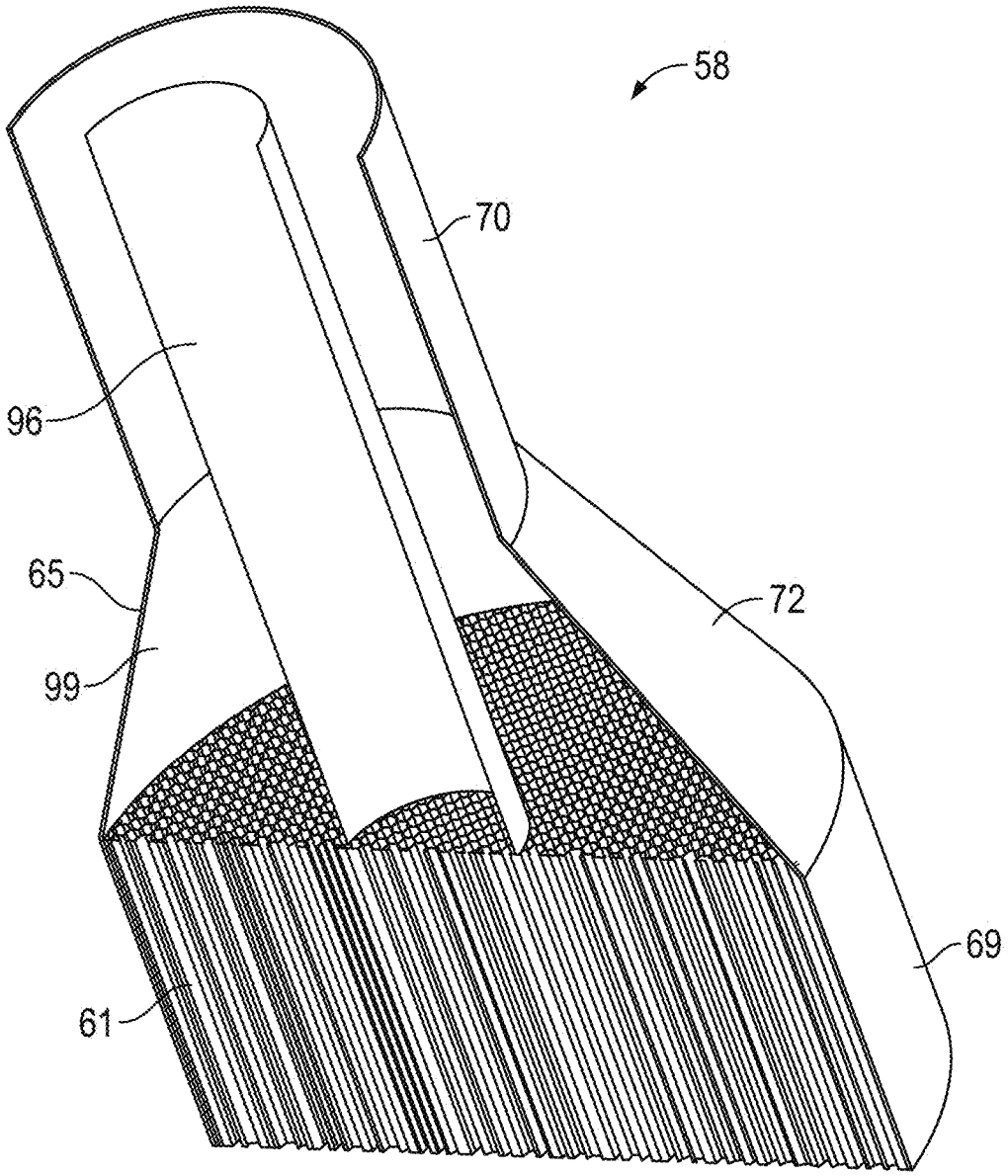
FIG. 30 is a pictorial cross-sectional view of an air profile generator in accordance with a twelfth embodiment of the present invention.

Reference is made to FIG. 30 which illustrates a pictorial cross-sectional view of an air profile generator 58 in accordance with the present invention which has close similarities to the air profile generator 58 of the eleventh embodiment of FIG. 29. In FIG. 30, the downstream air flow collimator 62 has been eliminated compared to that in FIG. 29 and a tubular air guide 96 provided similar to that in FIG. 29 but extended so as to extend coaxially through the cylindrical downstream portion 72. In FIG. 30, the annular passage 99 for air flow is provided between the guide tube member 96 and the wall 65 axially through the cylindrical downstream portion 70 and the reducing portion 72. In the embodiment of FIG. 30, the coaxial arrangement of the wall 65 over the cylindrical downstream portion 70 and the tube member 96, in effect, provide a downstream air flow collimator.

Figure 31:
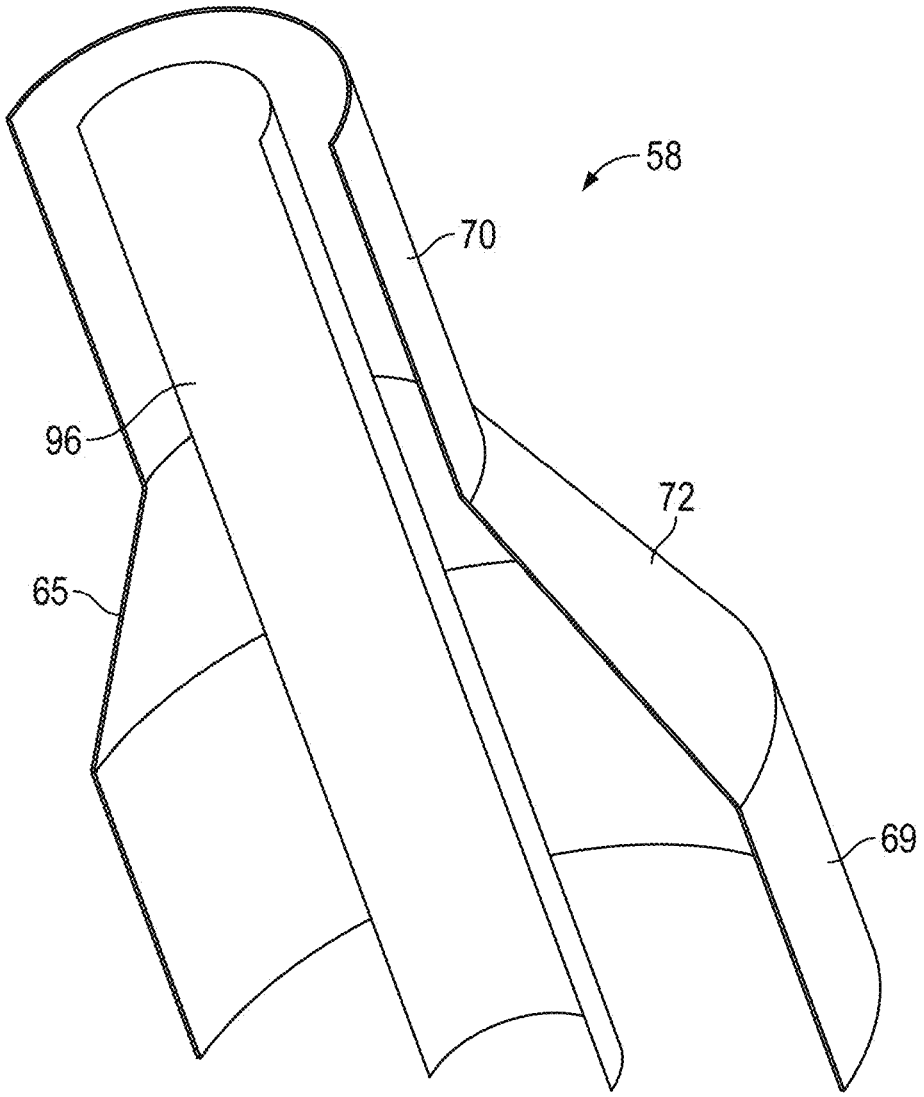
FIG. 31 is a pictorial cross-sectional view of an air profile generator in accordance with a thirteenth embodiment of the present invention.

Reference is made to FIG. 31 which illustrates an air profile generator 58 in accordance with a thirteenth embodiment. The air profile generator 58 in FIG. 31 has similarities to the air profile generator 58 of FIG. 30, however, modified so as to eliminate the upstream air flow collimator 61 in FIG. 30 and to extend the guide tube member 96 so that it passes annularly through the cylindrical upstream portion 69 as well as through the cylindrical downstream portion 70 and the reducing portion 72. Within the cylindrical upstream portion 69, the cylindrical wall 65 and the cylindrical tubular inner guide tube member 96 effectively form an air flow upstream collimator.

The present invention provides not only an apparatus for levitating an air drop of fluid but also a method of dispensing a fluid by levitating in air one or more drops of the fluid at a position where the drop is accessible to be taken by a user's hand. The preferred method is by aerodynamically levitating the drop with an upwardly directed flow of air, however, other methods of levitation could also be used.

Figure 3:
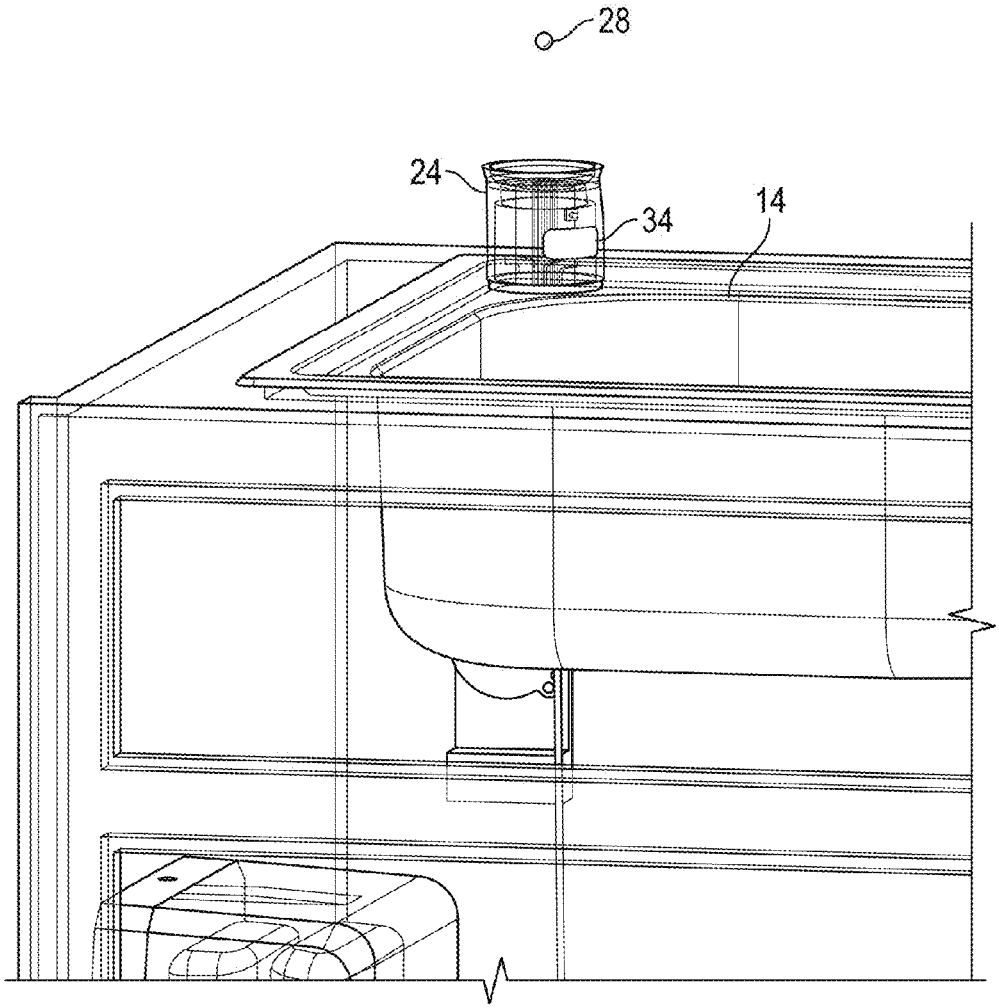
FIG. 3 shows an enlarged view of a levitating device of the hand cleaning station shown in FIG. 1.
Figure 4:
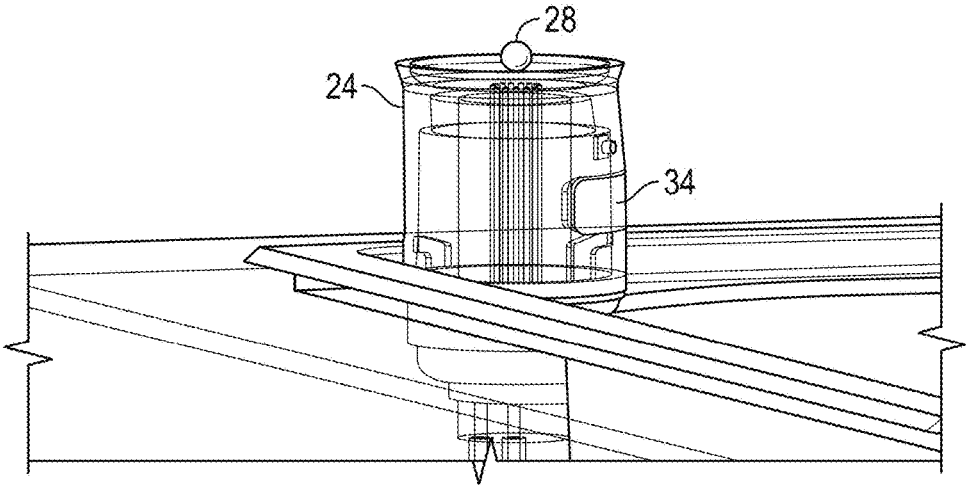
FIG. 4 shows an enlarged view of the levitating device of the hand cleaning station shown in FIG. 1, with a drop of hand cleaner fluid shown as it is being discharged from a dispenser outlet.
Figure 5:
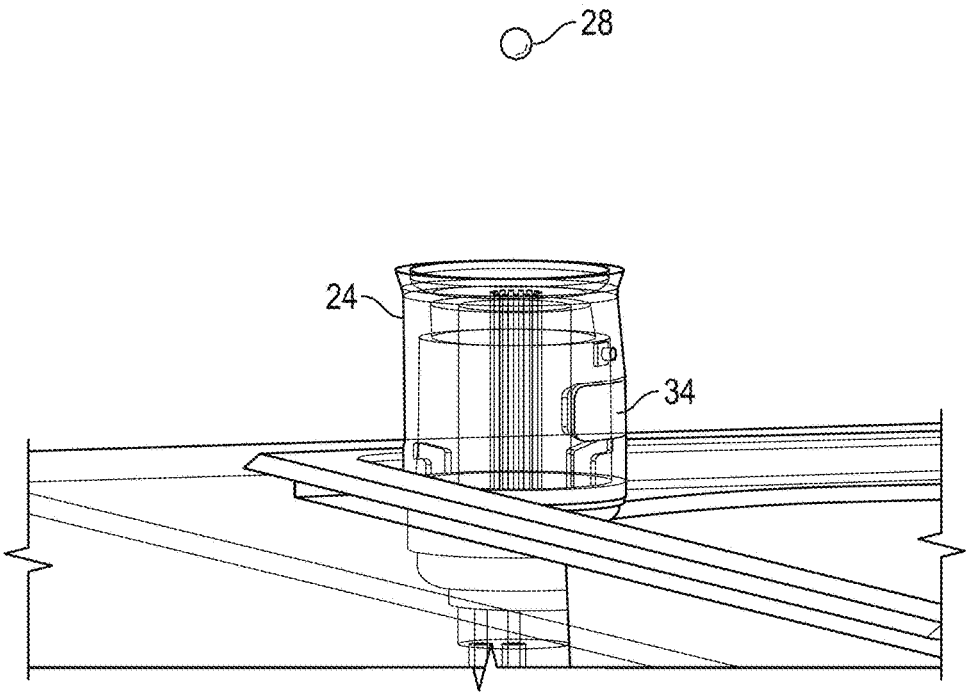
FIG. 5 shows the levitating device of FIG. 4, with the drop of hand cleaner fluid levitating thereabove.

Preferably, the method comprises levitating the drop at heights above the levitator device with an array of positions where the drop is accessible to be taken by a user's hand and the levitation is for some reasonable period of time that will permit the drop to actually be taken by a user's hand. In this context, as seen, for example, in FIG. 3, the drop 28 is levitated above the levitator device 24 at a location where the drop is accessible to be grasped by the hand of a user as, for example, the user's hand being moved horizontally as in a swipe to grasp the drop 28 with the user's hand. In the method of operating, the drop 28 may be levitated at varying heights within the air cushion as the air cushion may vary with time albeit with the drop 28 being maintained at the positions where the drop can be taken by a user's hand.

Preferably, the drop 28 is levitated for a period of time adequate to permit a user to see the drop and to then take the drop with a user's hand. Preferably, this period of time may be at least one second although, more preferably, the period of time may be two, three or four seconds or a relatively considerable period of time such as, for example, twenty, thirty or sixty seconds or more. After an individual drop has been levitated for a period of time then, preferably, the levitation is stopped as, with time, some drops will come to have reduced mass and may be ejected.

In accordance with the present invention, the device may be operated in accordance with a method so that while levitating the first drop, a second drop is levitated to also be accessible to be taken by a user's hand. Thus, two or more drops may be levitated at the same time. Depending upon whether the drops have the same size or mass, the drops may in fact be levitated as independent drops. The levitating of two independent drops could be accomplished with each of the drops dispensed from a different outlet 32 with, for example, no mixing of the liquids of the two drops to mix until such time as the drops are grasped by the hand of a user. Alternatively, where two drops of different materials are desired to be mixed in a user's hand, it may be possible to discharge a first drop to be grasped by a user and only then to discharge a second drop to be levitated and grasped by a user.

In accordance with a preferred operation of the dispenser and a method of operation, a person sensor is provided so as to sense when a user is proximate to the dispenser as, for example, within a few feet of the dispenser albeit not so close to the dispenser as to have a typical user grasp a drop with the user's hand. The dispenser may be operated on the approach of such a user with the intention of enticing the user's interest and to draw the user towards the device due to their interest or curiosity such that the user may take the drop. The person sensor or another sensor may be provided so as to provide an indication whether or not a user is sufficiently close to the dispenser that a typical user could take the drop with a user's hand. A drop sensor may preferably be provided so as to give an indication as to whether or not at any time there is a drop being levitated. Provision of one or more of these sensors can provide for advantageous operation of the dispenser in a number of manners. For example, after a drop is levitated, the sensor sensing whether or not a drop is levitated will discontinue providing the air flow if a signal is provided that no drop is being levitated. The fact that no drop is being levitated could arise, for example, by a drop that is ejected and not being levitated or by a user's hand grasping a drop. A hand sensor could be provided to determine whether or not a user's hand is moved through the air cushion in a manner that might remove a drop. Such a hand sensor to sense a hand moving through the air cushion might be more readily able to determine the expected removal of a levitated drop as contrasted with attempting to merely sense whether a drop continues to be levitated. After any drop is levitated, the device could be operated so as to discontinue air flow after a period of time. If there is a drop being levitated when air flow is to be stopped then, preferably, the device is operated to control levitation of the drop to cause the drop to descend downwardly towards a collection vessel on the dispenser.

In accordance with the preferred embodiments illustrated in FIG. 19, the tubular air guide 60 includes the cylindrical upstream portion 69, the intermediate reducing portion 72 and a cylindrical downstream portion 70. It is to be appreciated that insofar as the reducing portion 72 is provided so as to connect the exit end of the upstream air flow collimator 61 to the inlet end of the downstream air flow collimator 62, there is no need for the cylindrical upstream portion 69 or the cylindrical downstream portion 70. Insofar as the cylindrical upstream portion 69 and the cylindrical downstream portion 70 are provided, then the intermediate reducing portion 72 may be considered a connecting shroud 72 providing an internal guide passageway extending between the exit end of the upstream air flow collimator and the inlet end of downstream air flow collimator.

The air profile generator 58 as shown in FIG. 19 provides an internal guide passageway for air flow coaxially therethrough with a guide passageway having at each point along the axis 64 a cross-sectional area normal to the axis. As can be seen, the cross-sectional area of the guide passageway normal to the axis does not increase from the exit end of the upstream air flow collimator 61 to the inlet end of the downstream air flow collimator 62. Over the intermediate reducing portion 72, the cross-sectional area of the guide passageway normal the axis reduces gradually with proximity to the inlet to the downstream air flow collimator 62.

It will be understood that, although various features of the invention have been described with respect to one or another of the embodiments of the invention, the various features and embodiments of the invention may be combined or used in conjunction with other features and embodiments of the invention as described and illustrated herein.

It is to be appreciated that the term "hand cleaner fluid" as used herein is intended to refer broadly to any hand cleaning substance that is capable of being levitated, including for example, liquid soaps, liquid sanitizers, gels, creams, foams, capsules, and composite materials.

It is to be appreciated that the hand cleaner dispenser 18 of the present invention need not have the specific constructions that have been shown and described in the preferred embodiments. Rather, any alternate constructions that are able to provide a levitating allotment of hand cleaner fluid could be used.

While the levitator device 24 has been described as using air flow to provide an air cushion, it is to be appreciated that the invention is not strictly limited to this mode of levitation. Rather, the levitator device 24 could use any appropriate levitation mechanism, including but not limited to electromagnetic levitation, electrostatic levitation, acoustic levitation, and aerodynamic levitation. The device 24 may, for example, incorporate one or more features of the aerodynamic levitation device disclosed in U.S. Pat. No. 5,215,688 to Williamson et al., issued Jun. 1, 1993, which is hereby incorporated by reference.

While a hand cleaner dispenser 18 has been described as being installed beside a sink 14 and faucet 12, it is to be appreciated that the dispenser 18 could be installed on its own as a standalone unit.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

We claim:

1. A method of dispensing a fluid onto a user's hand characterized by:

levitating in air a first drop of the fluid where the drop is accessible to be taken by the user's hand; and moving the user's hand to take the drop.

2. The method of claim 1 wherein while levitating the first drop, levitating a second drop of the fluid accessible to be taken by a user's hand proximate where the first drop is accessible to be taken by a user's hand.

3. The method of claim 1 including, after levitating the drop for a period of time, collecting the drop in a collection vessel by controlling levitation of the drop to cause the drop to descend downward towards the collection vessel.

4. A method as claimed in claim 1 wherein the fluid includes one or more of a skin cleaner, a skin moisturizer, a skin disinfectant, a skin medication, an insect repellent and a skin perfume.

5. A method as claimed in claim 1 wherein the fluid comprises a hand cleaning fluid.

6. The method of claim 1 comprising aerodynamic levitating the drop with an upwardly directed flow of air.

7. A method as claimed in claim 6 wherein the fluid includes one or more of a skin cleaner, a skin moisturizer, a skin disinfectant, a skin medication, an insect repellent and a skin perfume.

8. The method of claim 6 comprising levitating the drop with a levitating device for a period of time at a height above the levitator device within a range of positions where the drop is accessible to be taken by a user's hand.

9. The method of claim 8 wherein the range of positions where the drop is accessible to be taken by a user's hand permits the drop to be grasped by the user's hand without the user's hand engaging anything other than the drop and air within which the drop is levitated.

10. The method of claim 9 including:

monitoring whether or not the drop is at a height above the levitator device within a range of positions where the drop is accessible to be taken by a user's hand.

11. The method of claim 9 including:

providing a reservoir for containing a fluid to be dispensed;

discharging an allotment of the fluid from the reservoir out a discharge outlet to form the drop;

discharging the drop into the upwardly directed flow of air with a velocity and at a direction that the drop is directed by a velocity profile of the upwardly directed flow of air to levitate the drop above a central portion of the velocity profile.

12. A method as claimed in claim 11 wherein the fluid includes one or more of a skin cleaner, a skin moisturizer, a skin disinfectant, a skin medication, an insect repellent and a skin perfume.

13. A method of dispensing a fluid characterized by:

sensing when a user is proximate to a levitator device, and on sensing a user to be proximate to the levitator device, aerodynamically levitating in air a first drop of the fluid with an upwardly directed flow of air for a period of time at a height above the levitator device within a range of positions where the drop is accessible to be taken by a user's hand, wherein the range of positions where the drop is accessible to be taken by the user's hand permits the drop to be grasped by the user's hand without the user's hand engaging anything other than the drop and the air within which the drop is levitated.

14. A method as claimed in claim 13 wherein the fluid includes one or more of a skin cleaner, a skin moisturizer, a skin disinfectant, a skin medication, an insect repellent and a skin perfume.

15. The method of claim 13 including repeatedly levitating successive drops of the liquid while the user is sensed to be proximate to where the drop is to be levitated.

16. The method of claim 15 including, after levitating in air, each successive drop of fluid where each successive drop is accessible to be taken by a user's hand for a period of time, levitating in air a next successive drop of the fluid where the drop is accessible to be taken by a user's hand.

17. The method of claim 13 including:

while a user is sensed to be proximate where the drop is to be levitated, (i) performing a series of steps of:

(a) conducting a first monitoring indicating that a first drop was at a height above the levitator device within a range of positions where a drop is accessible to be taken by a user's hand, followed by (b) conducting a second monitoring indicating that a first drop is not at a height above the levitator device within a range of positions where the drop is accessible to be taken by a user's hand, and (c) promptly levitating a subsequent drop and (ii) repeating the series of steps (i) and (ii) until the cumulative volume of fluid of the first drop and each successive drop represents a predetermined volume suitable for a predetermined use of the fluid.

18. A method as claimed in claim 17 wherein the fluid includes one or more of a skin cleaner, a skin moisturizer, a skin disinfectant, a skin medication, an insect repellent and a skin perfume.

19. A method as claimed in claim 13 including:

moving the user's hand to take the drop.

20. A method as claimed in claim 19 wherein the fluid includes one or more of a skin cleaner, a skin moisturizer, a skin disinfectant, a skin medication, an insect repellent and a skin perfume.

* * * * *